US012799766B2

(12) United States Patent
Bennett et al.

(10) Patent No.: US 12,799,766 B2
(45) Date of Patent: Nov. 17, 2026

(54) TRUCK ROOFTOP TENT

(71) Applicant: Wheel Pros, LLC, Greenwood Village, CO (US)

(72) Inventors: Jason Bennett, Queensland (AU); Matt Westhoff, Compton, CA (US)

(73) Assignee: TeraFlex, LLC, Greenwood Village, CO (US)

( * ) Notice: Subject to any disclaimer, the term of this patent is extended or adjusted under 35 U.S.C. 154(b) by 614 days.

(21) Appl. No.: 18/200,793

(22) Filed: May 23, 2023

(65) Prior Publication Data

US 2024/0076897 A1 Mar. 7, 2024

Related U.S. Application Data

(60) Provisional application No. 63/403,008, filed on Sep. 1, 2022.

(51) Int. Cl.
*E04H 15/06* (2006.01)
*E04H 15/48* (2006.01)
*E04H 15/56* (2006.01)

(52) U.S. Cl.
CPC ..... *E04H 15/06* (2013.01); *E04H 15/48* (2013.01); *E04H 15/56* (2013.01)

(58) Field of Classification Search
CPC ..... E06H 15/06
See application file for complete search history.

(56) References Cited

U.S. PATENT DOCUMENTS

| | | | | |
|---|---|---|---|---|
| 2019/0112831 | A1* | 4/2019 | Attema | E04H 15/008 |
| 2021/0270055 | A1* | 9/2021 | Park | E04H 15/48 |
| 2022/0098893 | A1* | 3/2022 | Chen | B60P 3/341 |
| 2022/0396967 | A1* | 12/2022 | Dunn | E04H 15/06 |
| 2024/0287829 | A1* | 8/2024 | Park | E04H 15/44 |
| 2025/0027330 | A1* | 1/2025 | Mayer | E04H 15/58 |
| 2025/0034900 | A1* | 1/2025 | May | E06C 1/125 |
| 2025/0059793 | A1* | 2/2025 | Robertson | E04H 15/48 |

FOREIGN PATENT DOCUMENTS

| | | | | |
|---|---|---|---|---|
| CN | 108468466 | A * | 8/2018 | E04H 15/06 |
| KR | 20150092023 | A * | 8/2015 | E04H 15/06 |
| WO | WO-2019227265 | A1 * | 12/2019 | E04H 15/06 |
| WO | WO-2024043778 | A1 * | 2/2024 | E04H 15/06 |
| WO | WO-2025063815 | A1 * | 3/2025 | E04H 15/48 |

* cited by examiner

*Primary Examiner* — David R Dunn
*Assistant Examiner* — Danielle Jackson
(74) *Attorney, Agent, or Firm* — Gregory Ozga; Butzel Long

(57) ABSTRACT

A hard-shell tent is secured to the top of a pickup truck or other suitable vehicle. The tent opens in a clamshell manner, and opens more than the standard 90 degrees, which gives this tent approximately 20% more usable space for occupants over the current designs. A unique hinge mechanism allows the tent to open approximately 110 degrees, which increases the usable area without increasing the footprint of the tent. The tent features a side slide/second folding section, and one or more internal shelves that fold into place automatically as the tent is opened.

20 Claims, 30 Drawing Sheets

TRUCK ROOFTOP TENT

CROSS REFERENCE TO RELATED APPLICATIONS

This utility patent application claims priority back to U.S. Provisional No. 63/403,008, filed Sep. 1, 2022, the contents of which are incorporated by reference into this application.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of folding tents, and more specifically, a tent designed for the top of a truck or other vehicle which can open more than 90 degrees, thereby allowing for more useful space than is available in the current tent designs.

Brief Description of Invention

The invention is a unique, hard-shell tent that is secured to the top of a pickup truck or other suitable vehicle. The tent opens in a clamshell manner, and opens more than the standard 80-90 degrees, which gives this tent approximately 20% more usable space for occupants over the current designs. A unique hinge mechanism allows the tent to open approximately 110 degrees, which increases the usable area without increasing the footprint of the tent and offers an ergonomic backrest to those in that section of the tent. The tent features a side slide, or outwardly folding section which rotates out 180 degrees opposite the first folding section, and one or more internal shelves that fold into place automatically as the tent is opened.

Prior Art

The placement of folding tents on top of vehicles is not new. The current market for folding tents on vehicles does approximately +$100 Million in the United States alone.

However, the current vehicle top folding tents are limited by their hinges to a 90-degree opening. The current invention, however, employs a unique hinge that allows the "top" of the tent to open up approximately 110 degrees-20 degrees more than the standard 80-degree hinge—thereby creating approximately 20% more usable area without increasing the footprint of the tent. The other advantage of the 100-degree hinge is that it angles the top of the tent at a convenient angle for a person to relax against—similar to how sofa backs are angled rather than directly vertical.

Thus, there has existed a long-felt need for a means by which rooftop tents can be more comfortable, and more spacious without increasing the footprint of the tent. The current invention provides just such a solution by having a hard-shell tent can be secured to the top of a pickup truck or other suitable vehicle, which opens approximately 110 degrees due to a unique hinge, giving the tent approximately 20% more useful area as well as providing a comfortable backrest. The tent features a second folding section, or side slide, and one or more internal shelves that fold into place automatically as the tent is opened. The tent is not heavier or taking up a larger footprint that the current tents but offers more space and more comfort.

Objects of the Invention

It is therefore an object of the present invention to provide a rooftop tent that has a hinge that allows an opening of more than 90 degrees It is a second object of the invention to provide a rooftop tent with a comfortable backrest.

It is a third object of the invention to provide a rooftop tent with a side slide and at least one internal shelf that automatically assembles itself as the tent is opened.

It is a fourth object of the invention to provide a rooftop tent with an equal collapsed footprint to the current rooftop tents but with additional advantages over the current rooftop tents.

There has thus been outlined, rather broadly, the more important features of the invention in order that the detailed description thereof may be better understood, and in order that the present contribution to the art may be better appreciated. There are additional features of the invention that will be described hereinafter, and which will form the subject matter of the claims appended hereto. The features listed herein, and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION OF THE FIGURES

Figure 1:
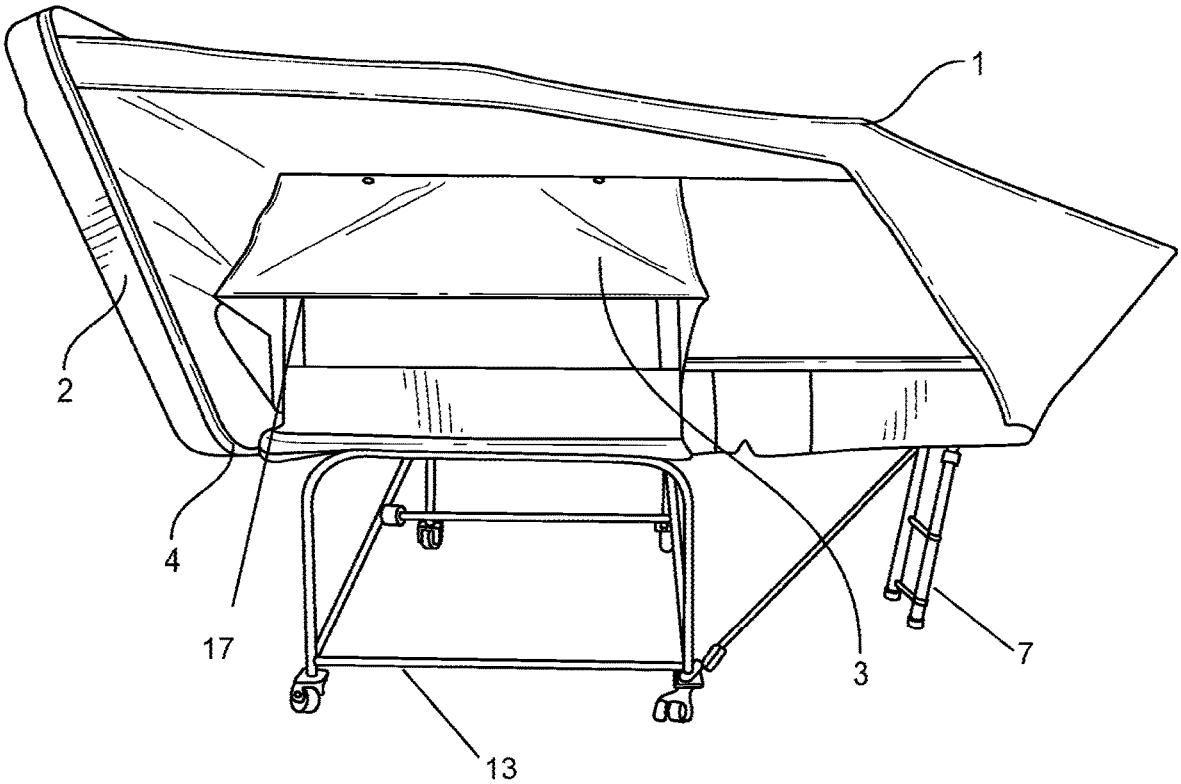
FIG. 1 is perspective view of the tent in a fully opened configuration, resting on an exhibition cart, according to a preferred form of the invention.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is perspective view of the tent in a fully opened configuration, according to a preferred form of the invention. The tent, 1 generally, is opened by rotating the top 2, approximately 110 degrees forward, a move made possible by the over 90-degree hinges 4. A second folding section or side slide (described and illustrated in further figures) further increases the useful area of the tent. A window awning 17 opens up on the side of the tent 1. A ladder 7, supports the side slide and allows access to the tent interior. In this figure, the tent 1 is set up on a Display Cart 13.

Figure 2:
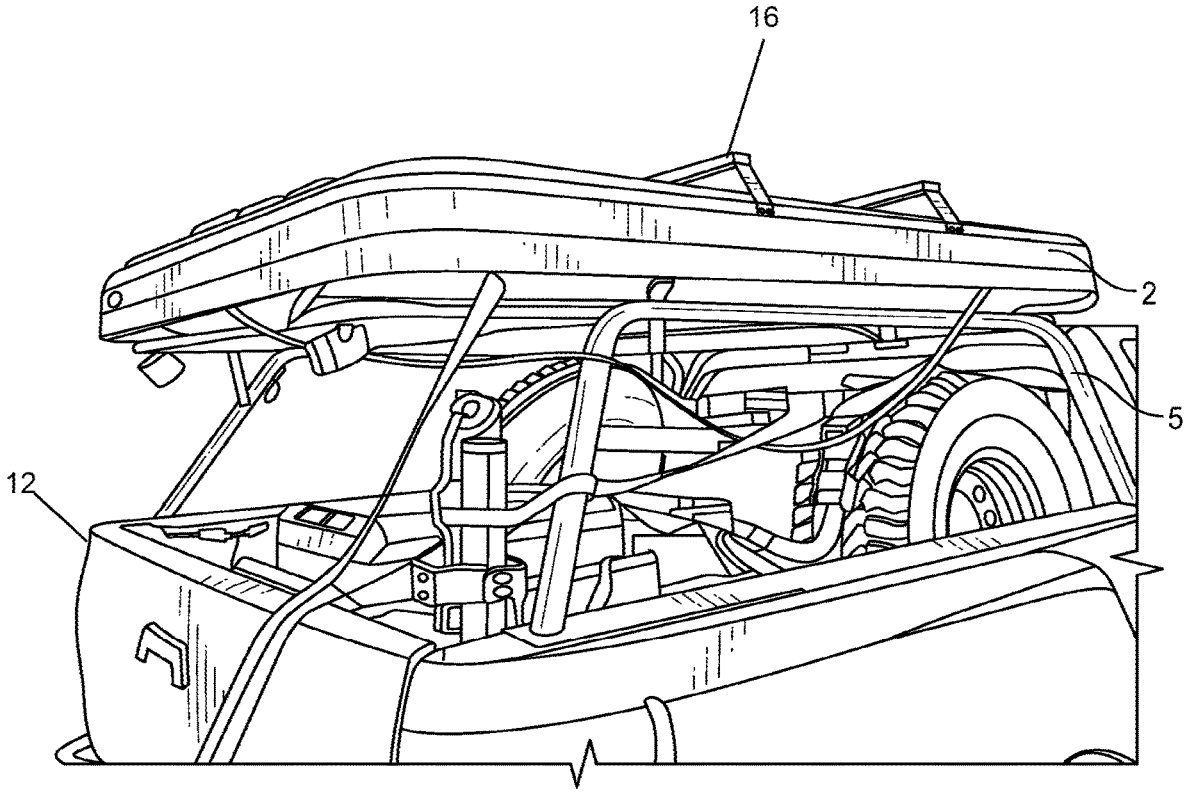
FIG. 2 is a perspective view of the tent in a closed position attached to the roof rack of a pickup truck.

FIG. 2 is a perspective view of the tent in a closed position attached to the roof rack of a pickup truck. The top 2 encloses and protects the foldable portions of the tent, which is secured to the bed rack 5 of a truck 12 by brackets. A cargo rack 16 is attached to the top 2 of the tent.

Figure 3:
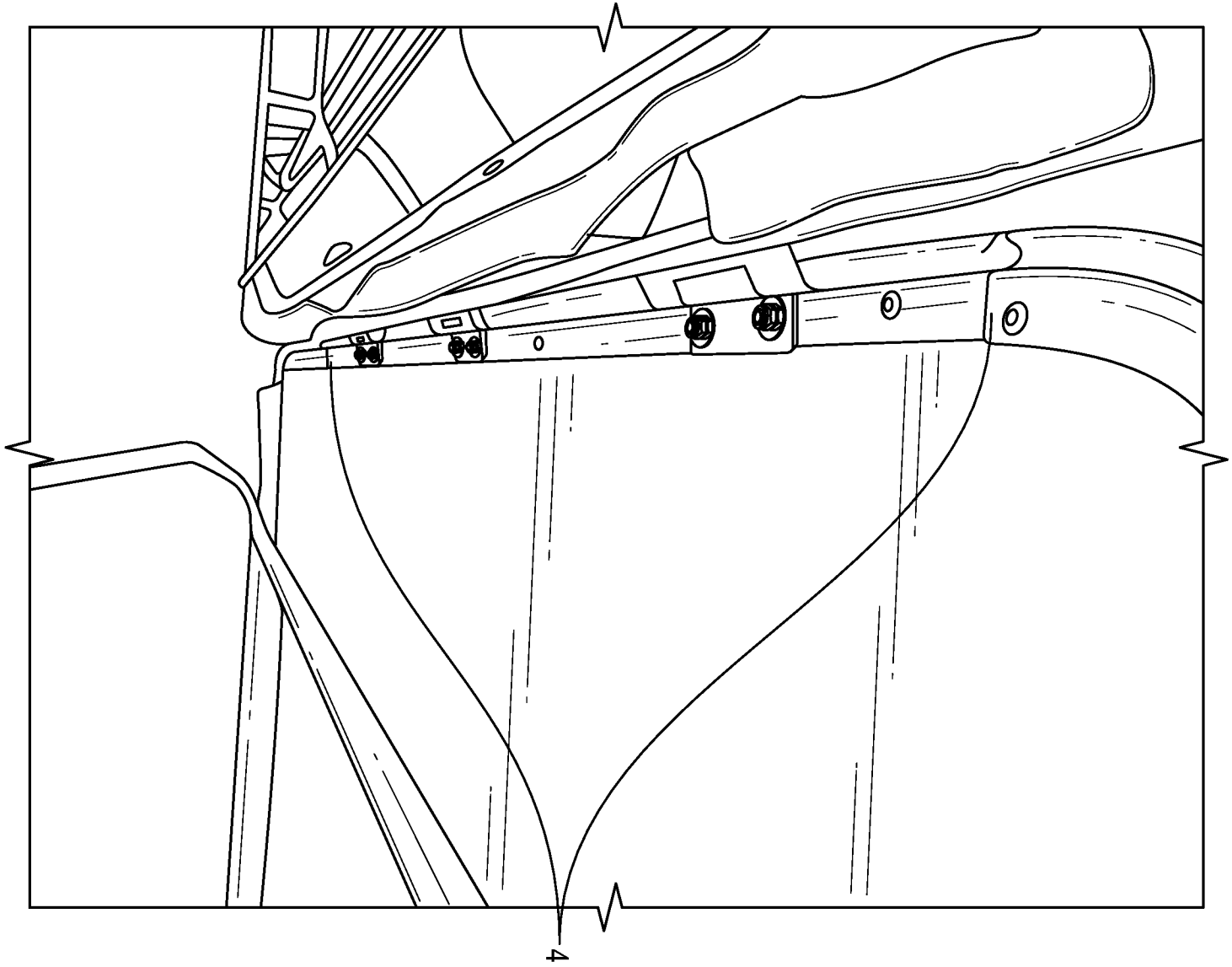
FIG. 3 is a bottom, perspective view of the hinge portion of the invention.

FIG. 3 is a bottom, perspective view of the hinge portion of the invention. The over 90-degree hinges 4 allow the top of the tent to be opened approximately 110 degrees, allowing for a larger usable space with the same footprint that would be had with a traditional rooftop tent.

Figure 4:
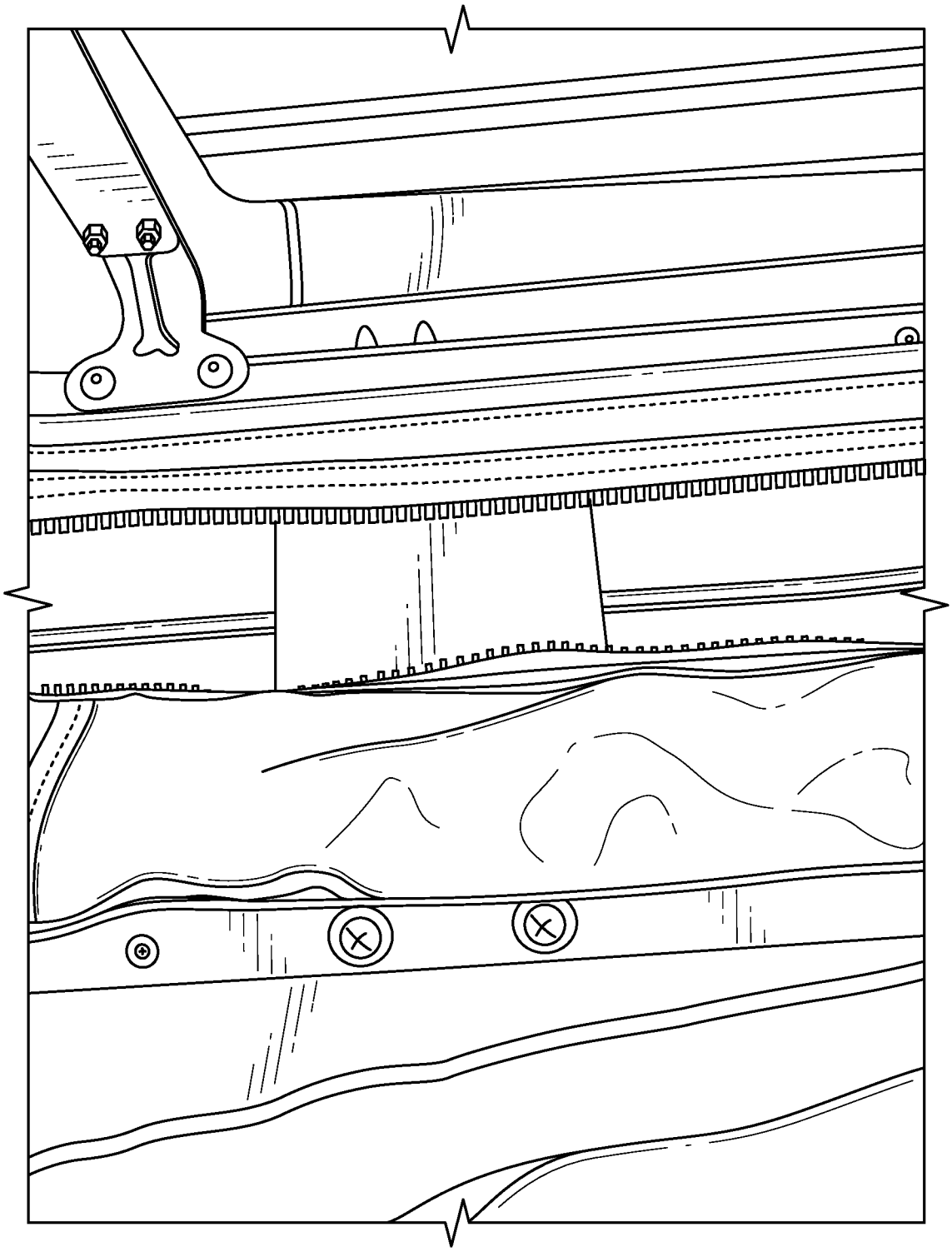
FIG. 4 is a close-up view of the over 90-degree hinge portion of the invention.

FIG. 4 is a close-up view of the over 90-degree hinge 4 portion of the invention.

Figure 5:
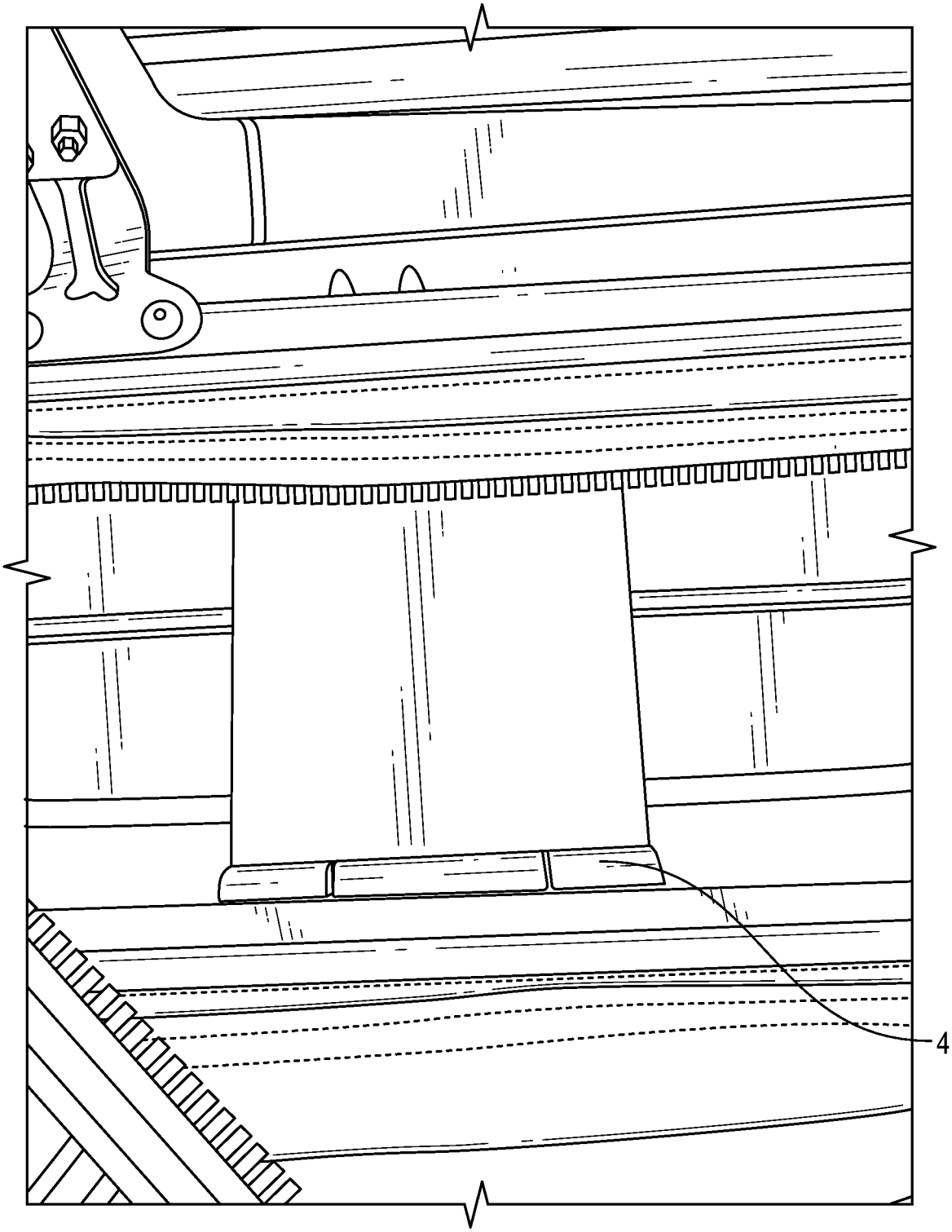
FIG. 5 is another close-up view of the over 90-degree hinge portion of the invention.

FIG. 5 is another close-up view of the over 90-degree hinge 4 portion of the invention.

Figure 6:
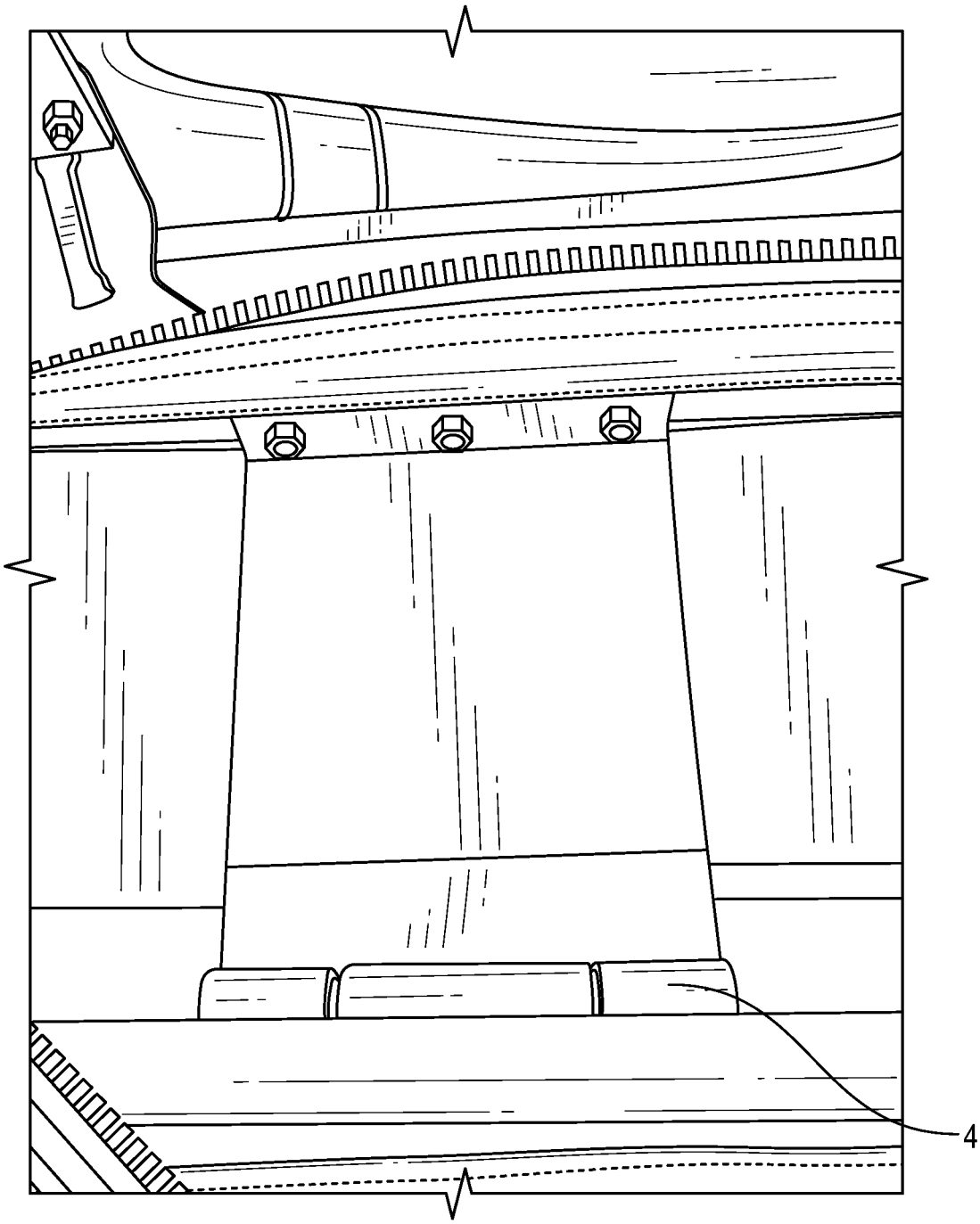
FIG. 6 is a close-up view of the over 90-degree hinge portion of the invention.

FIG. 6 is a close-up view of the over 90-degree hinge 4 portion of the invention.

Figure 7:
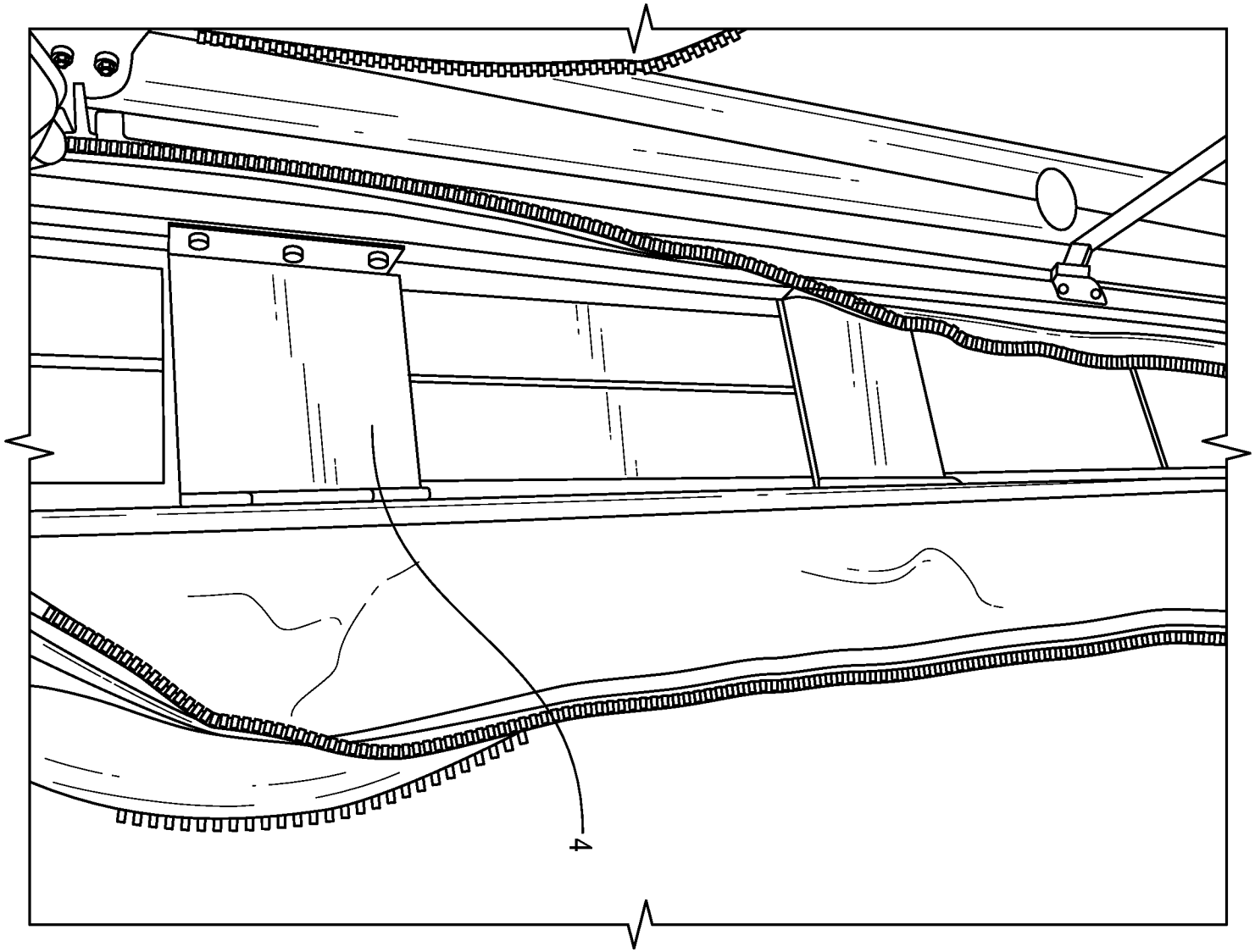
FIG. 7 is a close-up view of the over 90-degree hinge portion of the invention.

FIG. 7 is a close-up view of the over 90-degree hinge portion of the invention.

Figure 8:
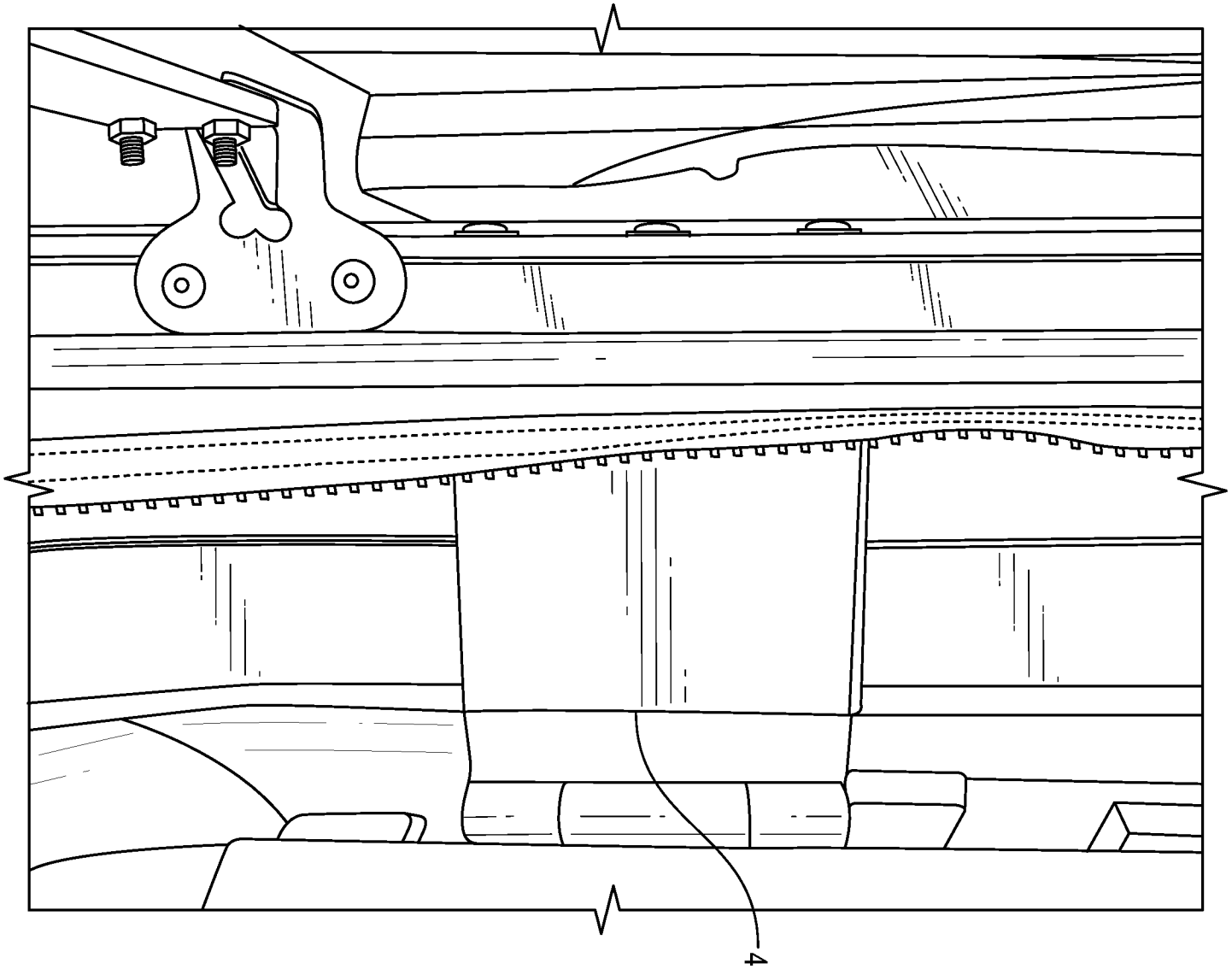
FIG. 8 is a close-up view of the over 90-degree hinge portion of the invention.

FIG. 8 is a close-up view of the over 90-degree hinge portion of the invention.

Figure 9:
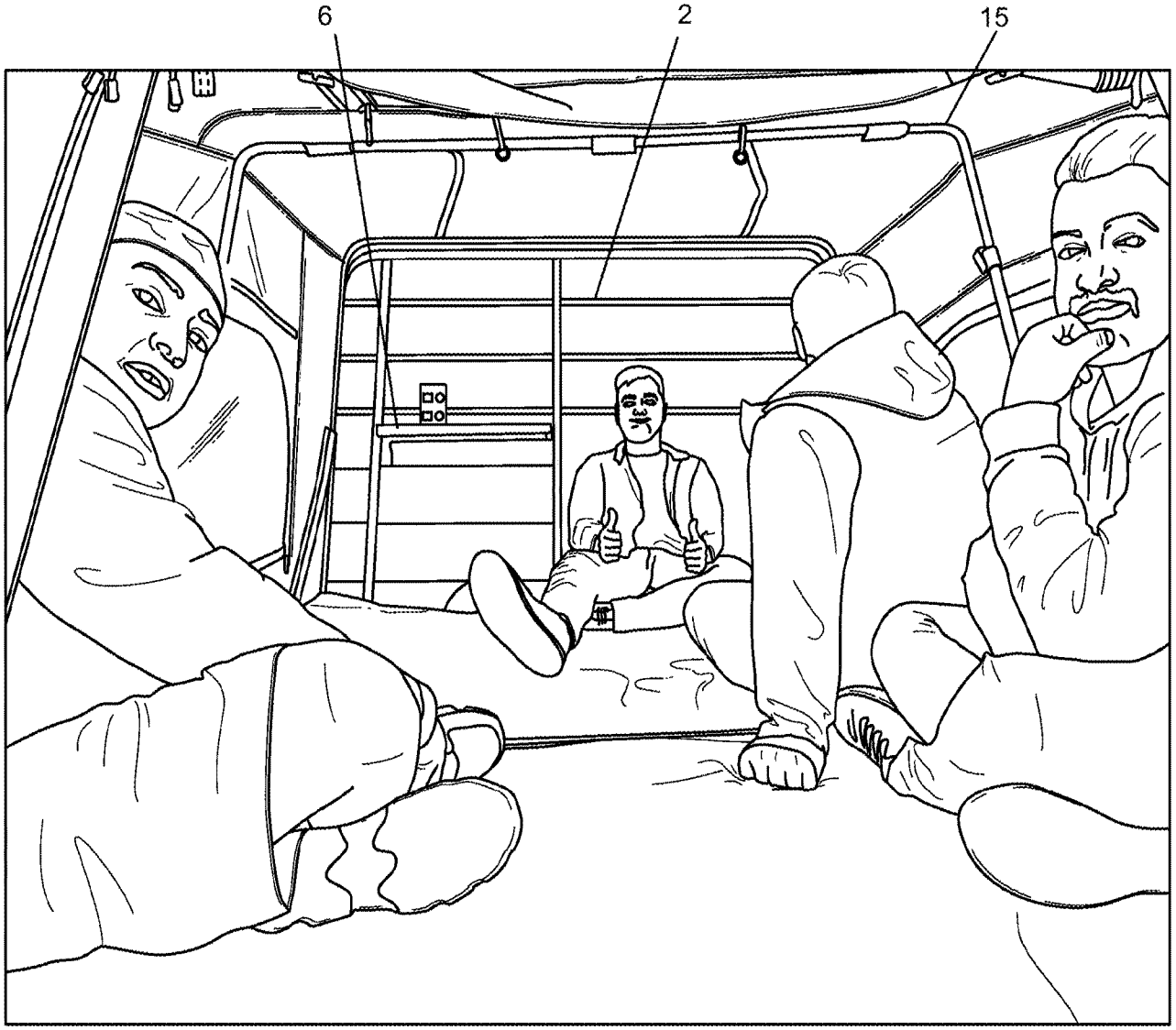
FIG. 9 is a perspective view of the tent in an open position being occupied by a number of campers, including a view of the shelf.

FIG. 9 is a perspective view of the tent in an open position being occupied by a number of campers, including a view of the shelf 6. The shelf 6 automatically unfolds as the top of the tent is pulled back during installation. This picture illustrates how by allowing the top of the tent to open more than 90 degrees, it gives the occupants significantly more room on the inside than would a traditional rooftop tent, and allows some campers to lean back against the back of the tent in a comfortable manner.

Figure 10:
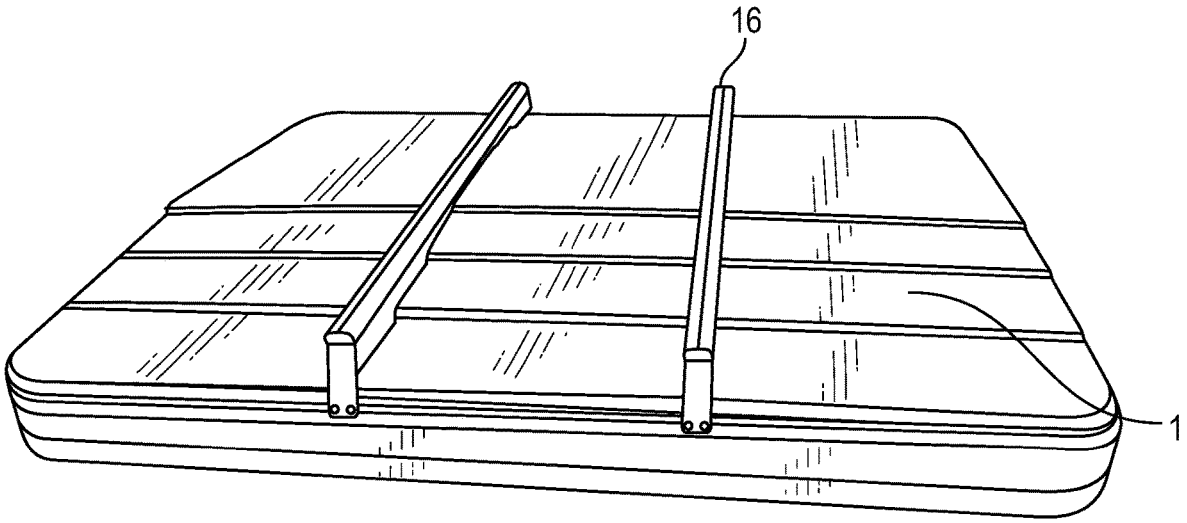
FIG. 10 is a perspective view of the outside of the unit, in a closed position.

FIG. 10 is a perspective view of the outside of the unit 1, in a closed position. The cargo racks 16 allow the user to store additional items on top of the tent 1.

Figure 11:
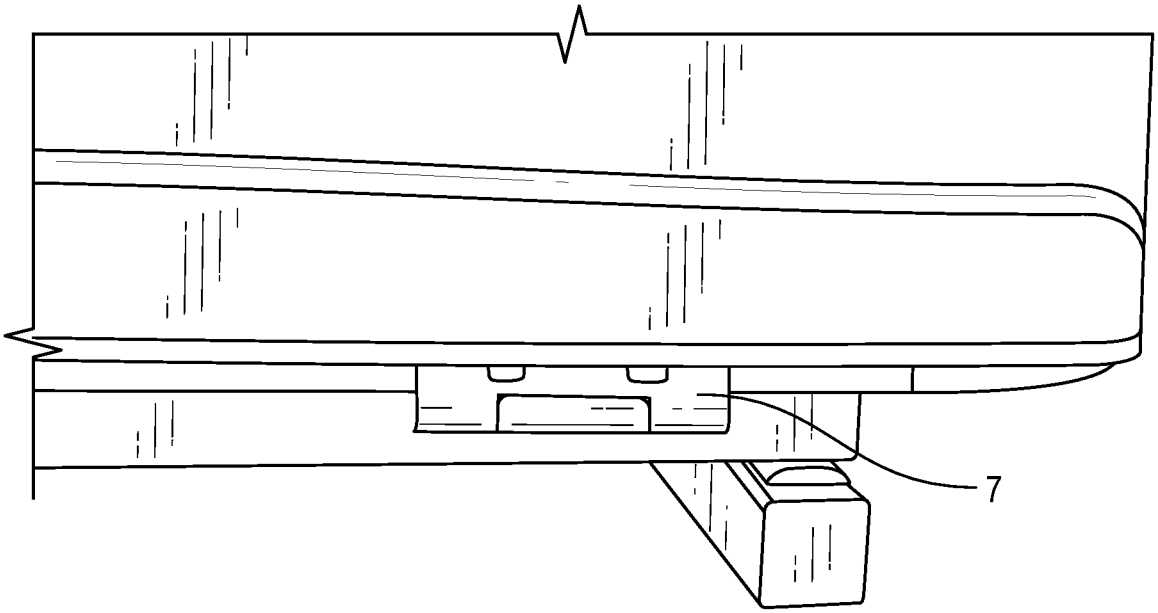
FIG. 11 is a perspective view of the outside of the unit, in a closed position, showing the clamp by which it attaches to a truck roof rack.

FIG. 11 is a perspective view of the outside of the unit, in a closed position, showing the bracket by which it attaches to a truck roof rack.

Figure 12:
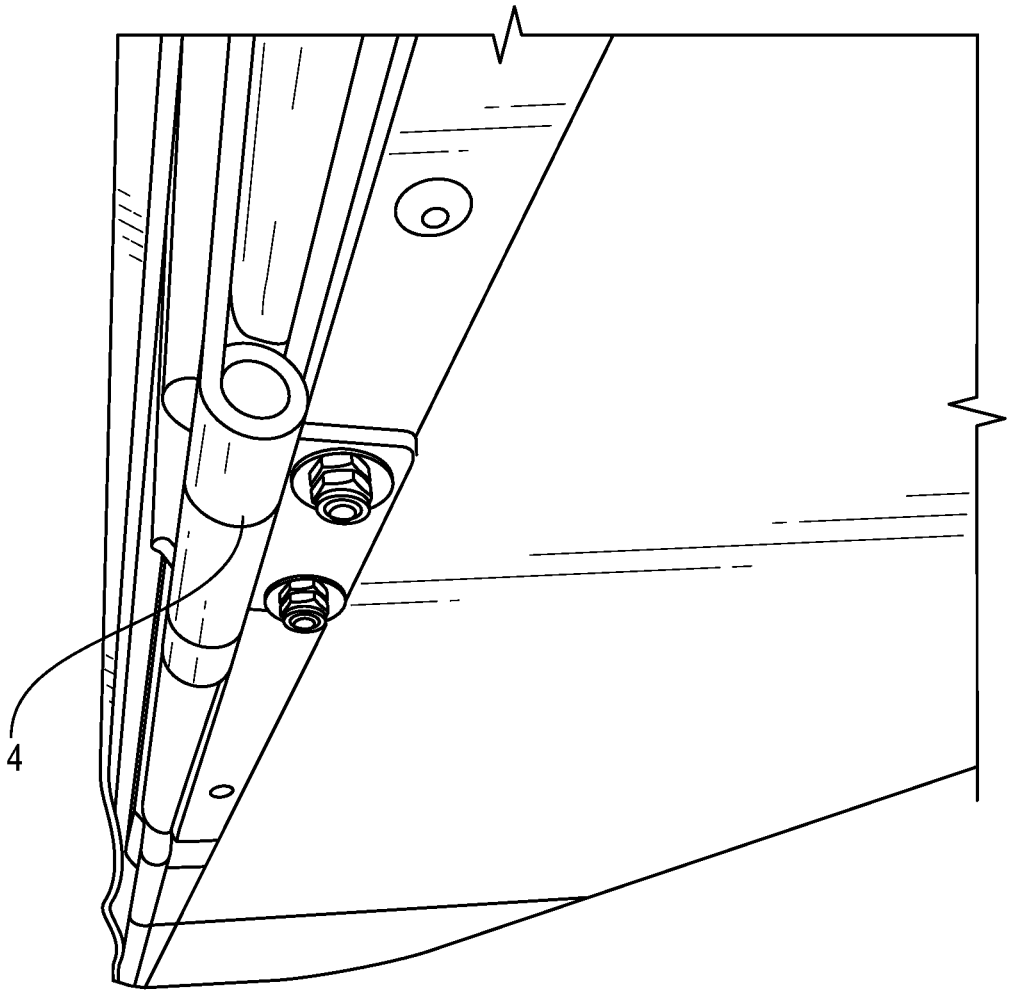
FIG. 12 is a perspective view of the underside of the unit, in a closed position, showing the over 90-degree hinge.

FIG. 12 is a perspective view of the underside of the unit, in a closed position, showing the over 90-degree hinge 4. When the tent is in a closed position, the hinge 4 works like a standard hinge, but when the tent is opened, the hinge can rotate beyond 90 degrees.

Figure 13:
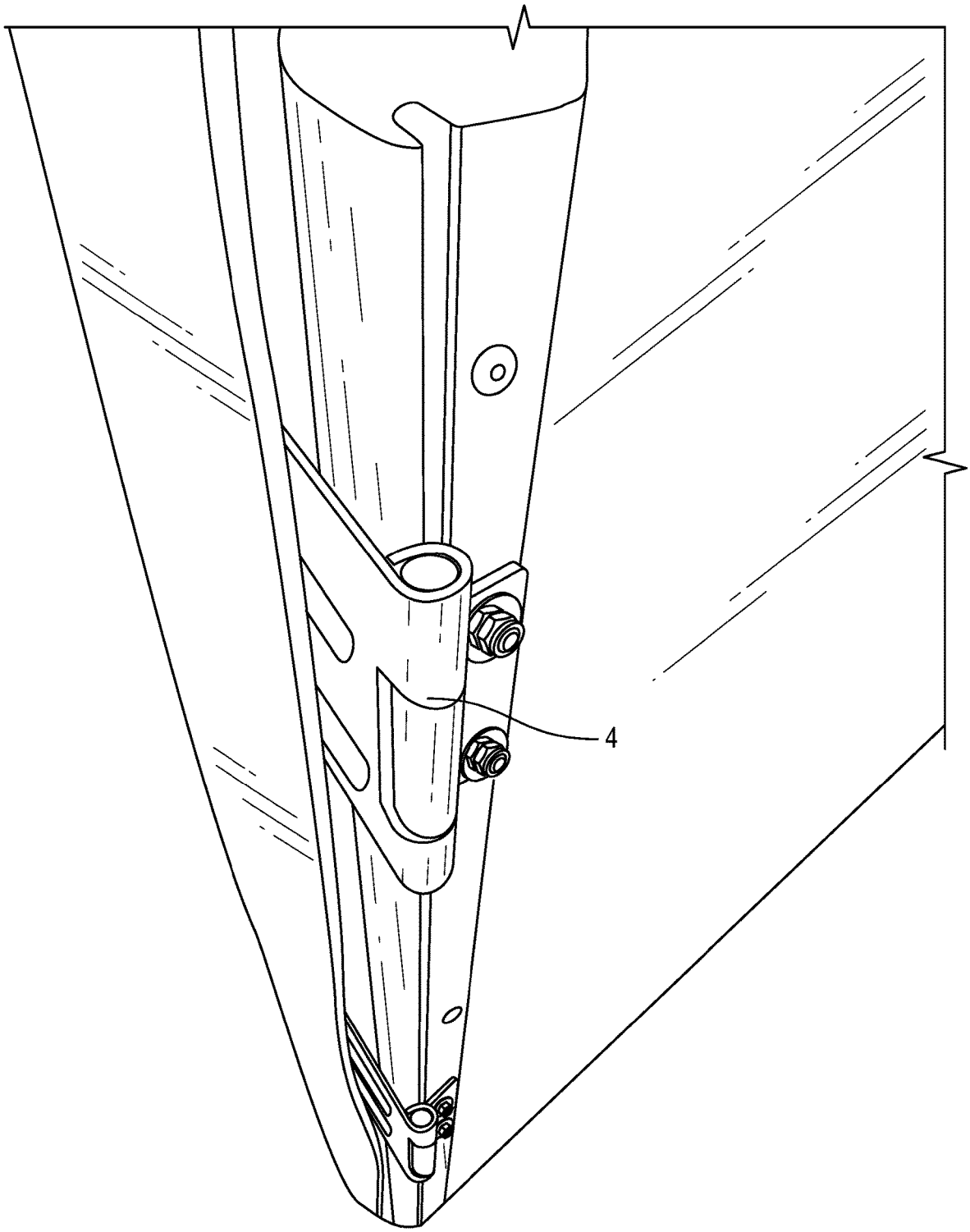
FIG. 13 is another perspective view of the underside of the unit, in a closed position, showing the over 90-degree hinge.

FIG. 13 is another perspective view of the underside of the unit, in a closed position, showing the over 90-degree hinge 4.

Figure 14:
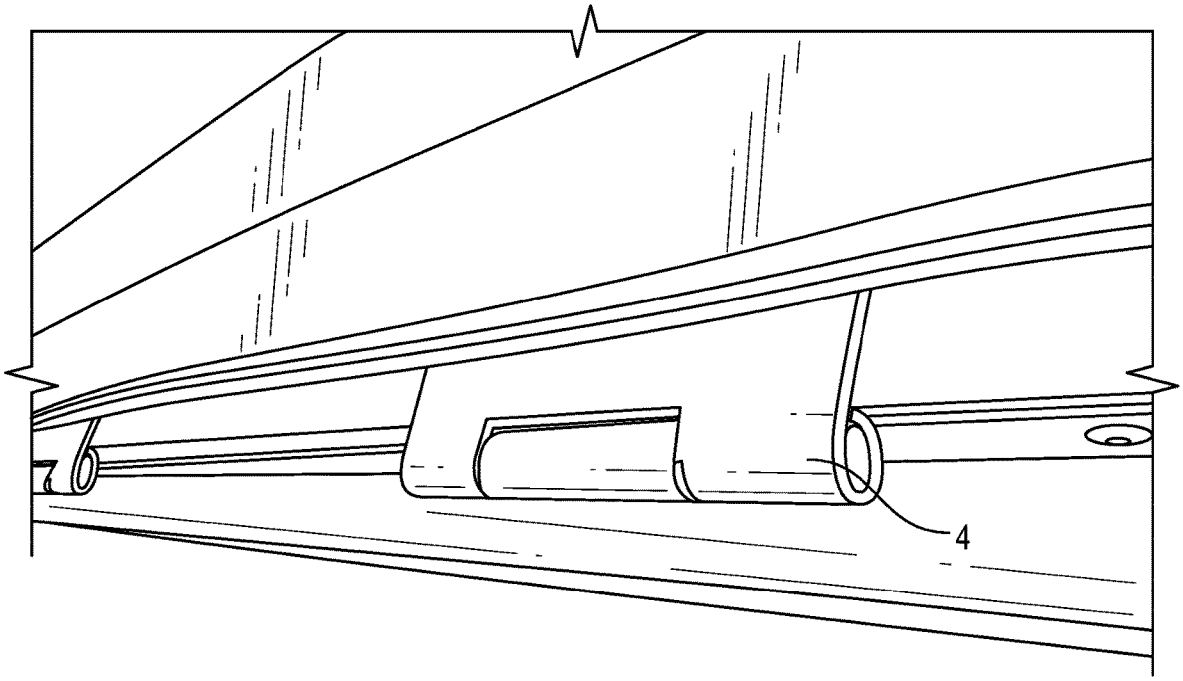
FIG. 14 is another perspective view of the underside of the unit, in a closed position, showing the over 90-degree hinge.

FIG. 14 is another perspective view of the underside of the unit, in a closed position, showing the over 90-degree hinge 4.

Figure 15:
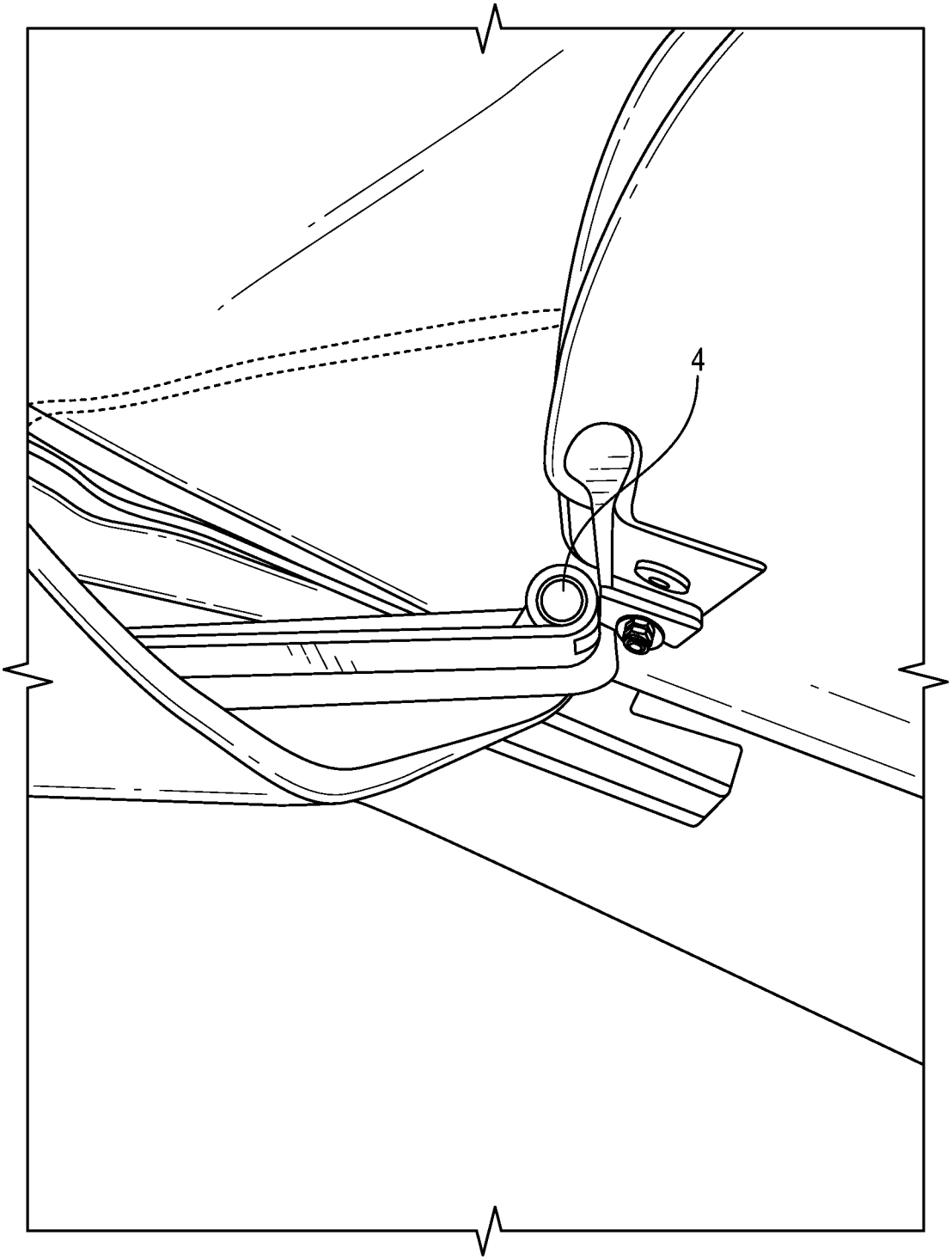
FIG. 15 is another perspective view of the underside of the unit, in a closed position, showing the over 90-degree hinge and how it can rotate more than the standard 90 degrees.

FIG. 15 is another perspective view of the underside of the unit, in a closed position, showing the over 90-degree hinge 4 and how it can rotate more than the standard 90 degrees.

Figure 16:
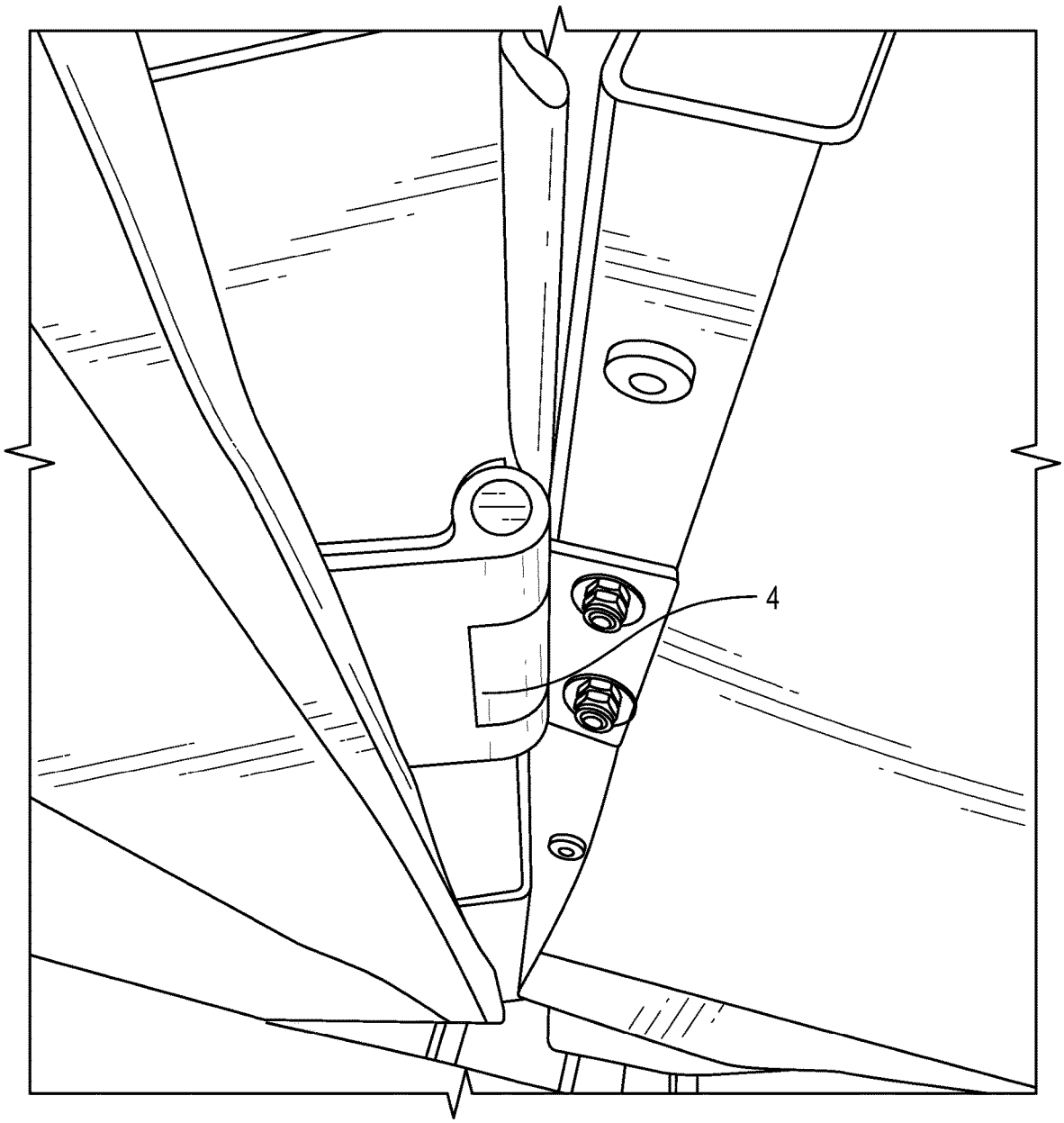
FIG. 16 is another perspective view of the underside of the unit, in a closed position, showing the over 90-degree hinge and how it can rotate more than the standard 90 degrees.

FIG. 16 is another perspective view of the underside of the unit, in a closed position, showing the over 90-degree hinge 4 and how it can rotate more than the standard 90 degrees.

Figure 17:
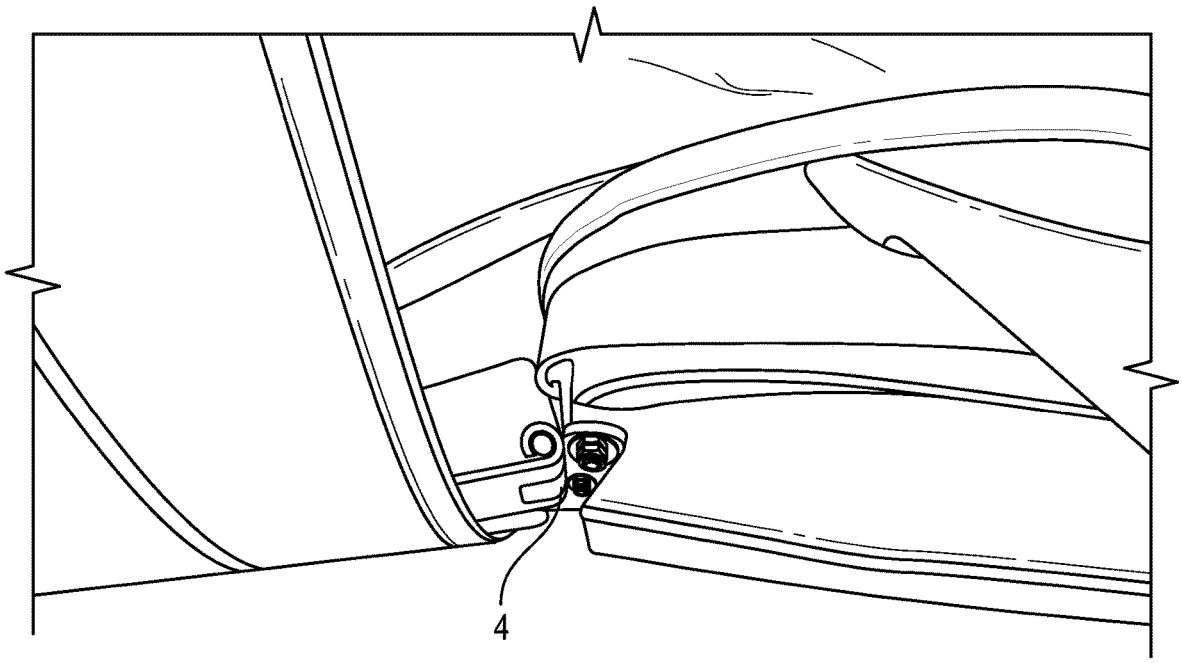
FIG. 17 is an end view of the underside of the unit, in a closed position, showing the over 90-degree hinge and how it can rotate more than the standard 90 degrees.

FIG. 17 is an end view of the underside of the unit, in a closed position, showing the over 90-degree hinge 4 and how it can rotate more than the standard 90 degrees.

Figure 18:
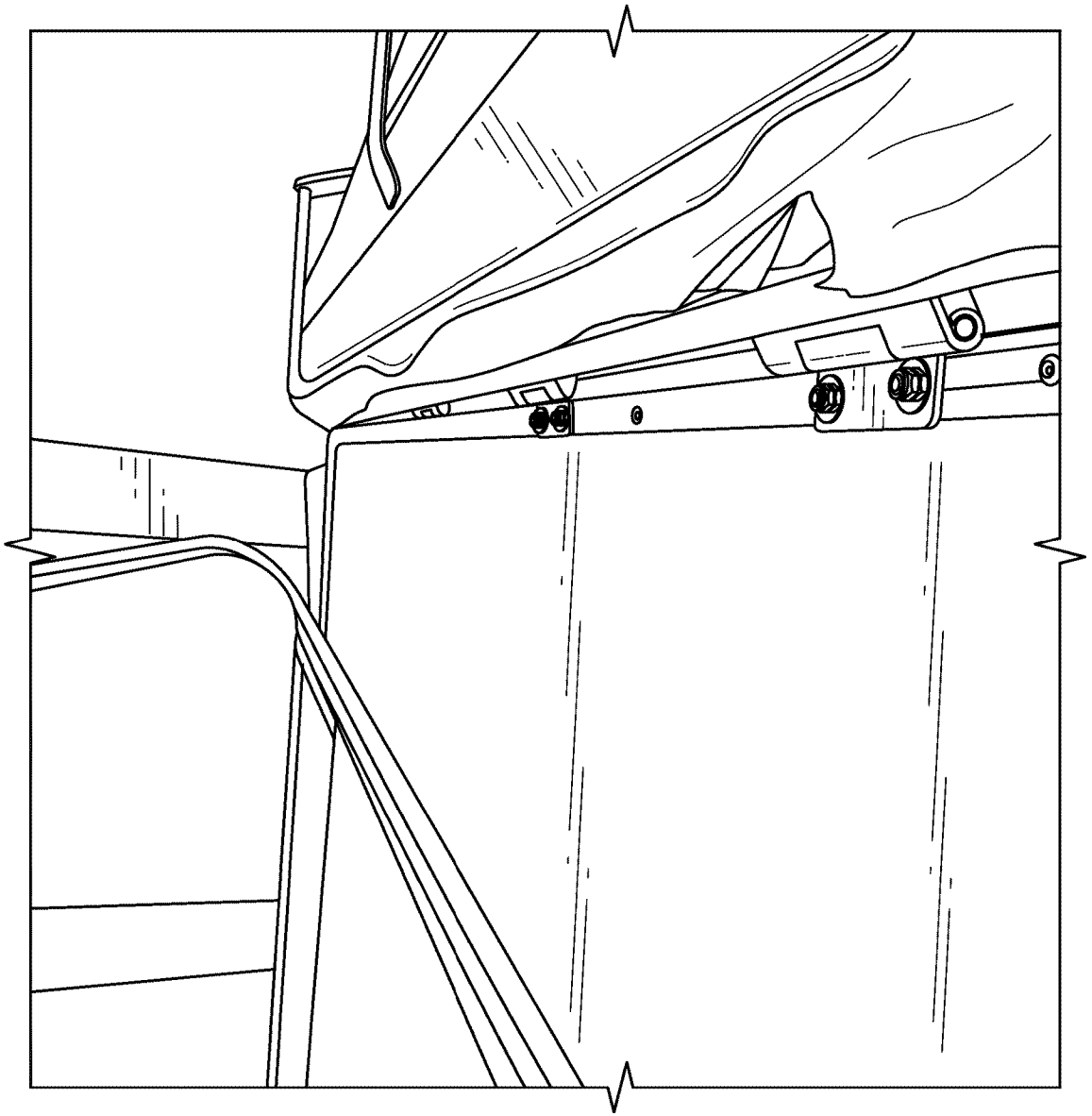
FIG. 18 is an underside, perspective view of the underside of the unit, in a closed position, showing the over 90-degree hinge and how it can rotate more than the standard 90 degrees.

FIG. 18 is an underside, perspective view of the underside of the unit, in a closed position, showing the over 90-degree hinge 4 and how it can rotate more than the standard 90 degrees.

Figure 19:
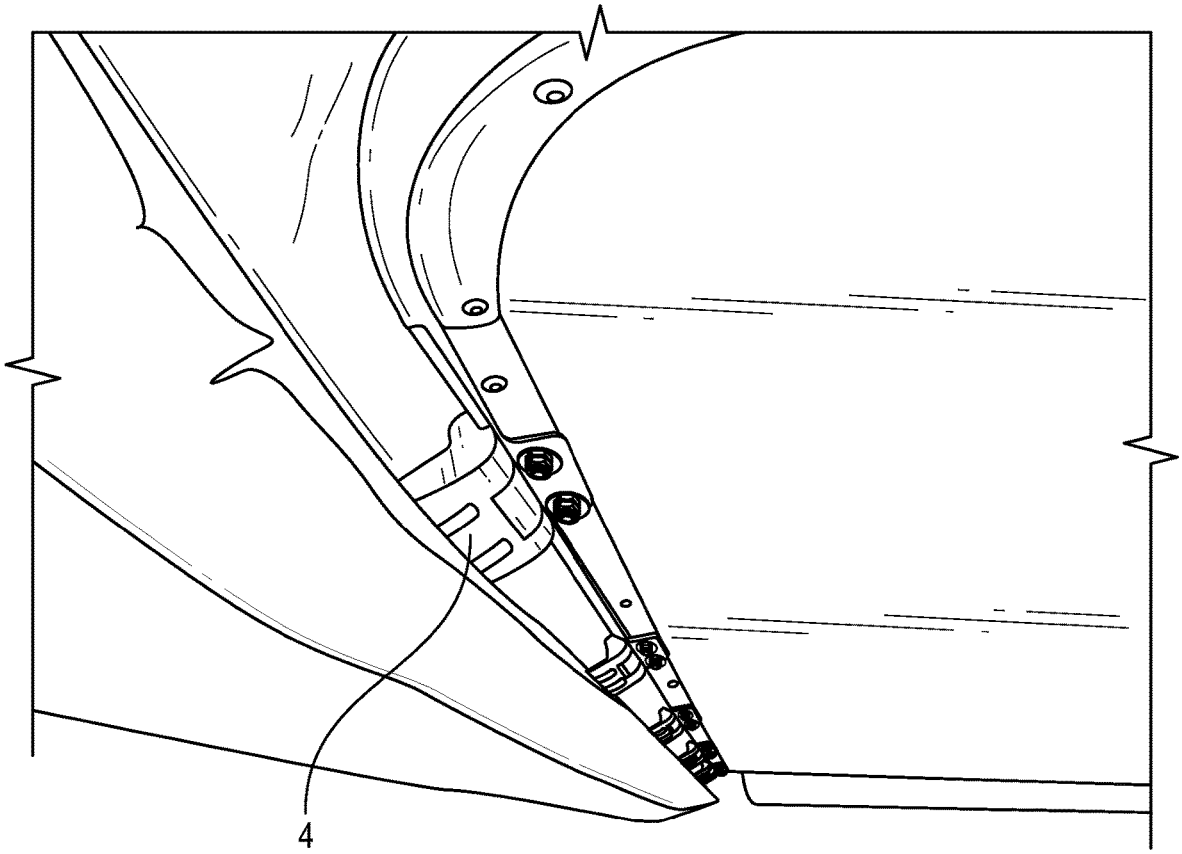
FIG. 19 is another underside, perspective view of the underside of the unit, in a closed position, showing the over 90-degree hinge and how it can rotate more than the standard 90 degrees.

FIG. 19 is another underside, perspective view of the underside of the unit, in a closed position, showing the over 90-degree hinge 4 and how it can rotate more than the standard 90 degrees.

Figure 20:
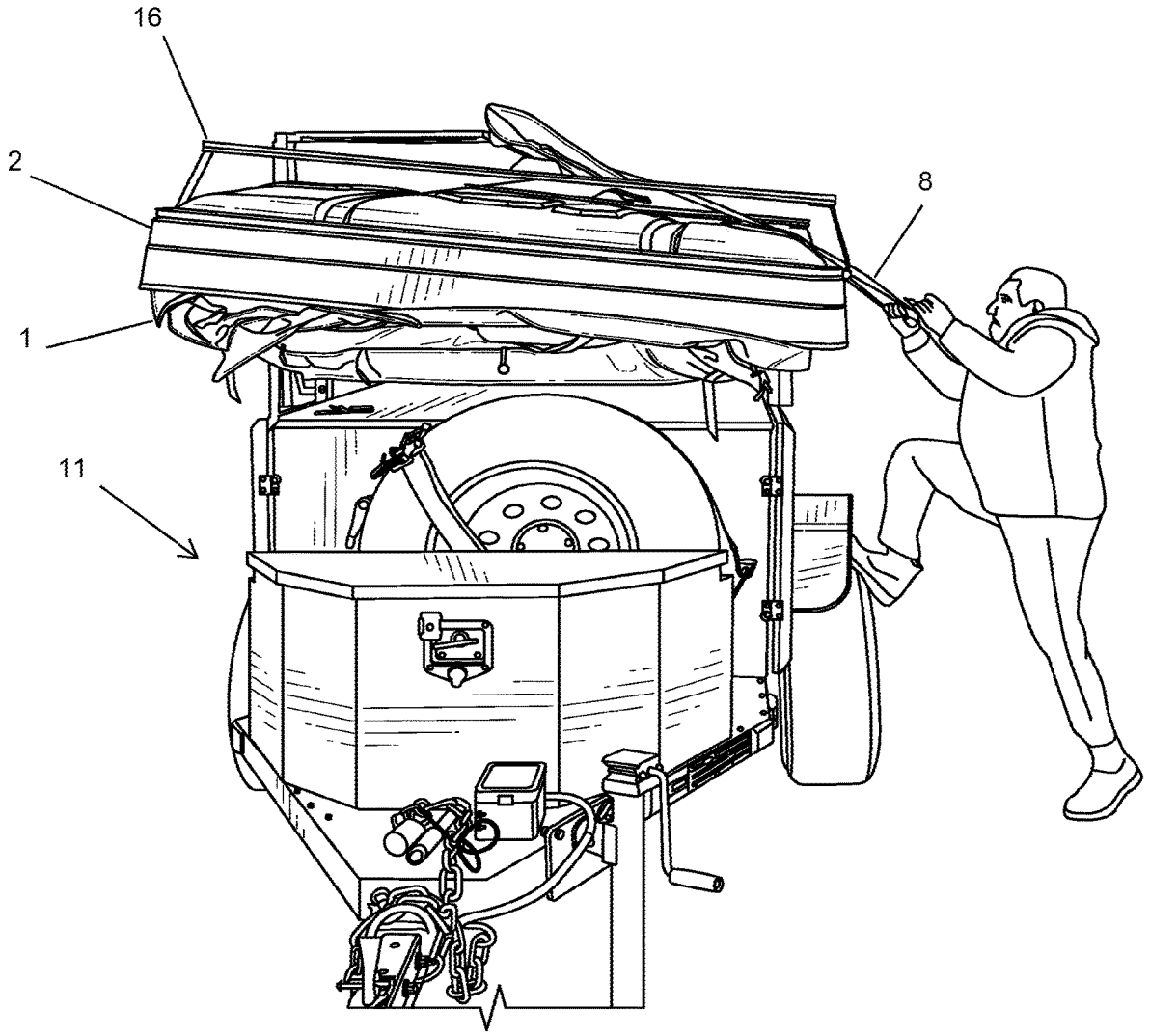
FIG. 20 is a perspective view of a user unfolding and assembling the tent from a trailer.

FIG. 20 is a perspective view of a user unfolding and assembling the tent from a trailer 11. It should be emphasized that the tent can be attached to any vehicle or trailer with some sort of upper structure to which the bottom of the tent can be attached. In FIGS. 20 through 26, a travel trailer is used for purposes of illustration only, and does not limit the use of the invention solely to trailers (or to trucks). A user pulls the pull rope 8, which rotates the top 2 of the tent out toward the user through use of the over 90-degree hinges.

Figure 21:
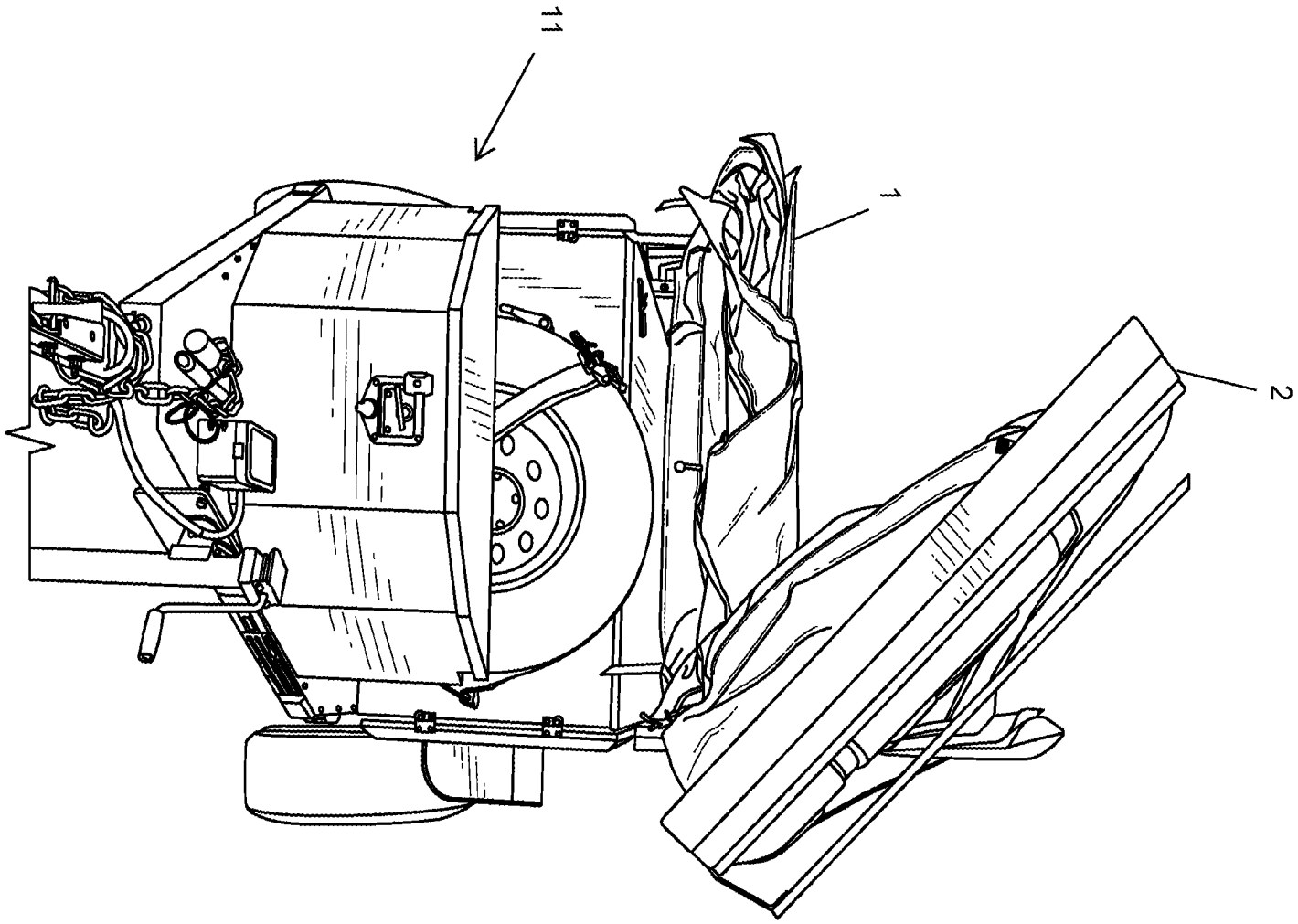
FIG. 21 is a perspective view of a user unfolding and assembling the tent from a trailer.

FIG. 21 is a perspective view of a user unfolding and assembling the tent from a trailer. As the top 2 rotates outward, the inner fold-out section 9 becomes accessible.

Figure 22:
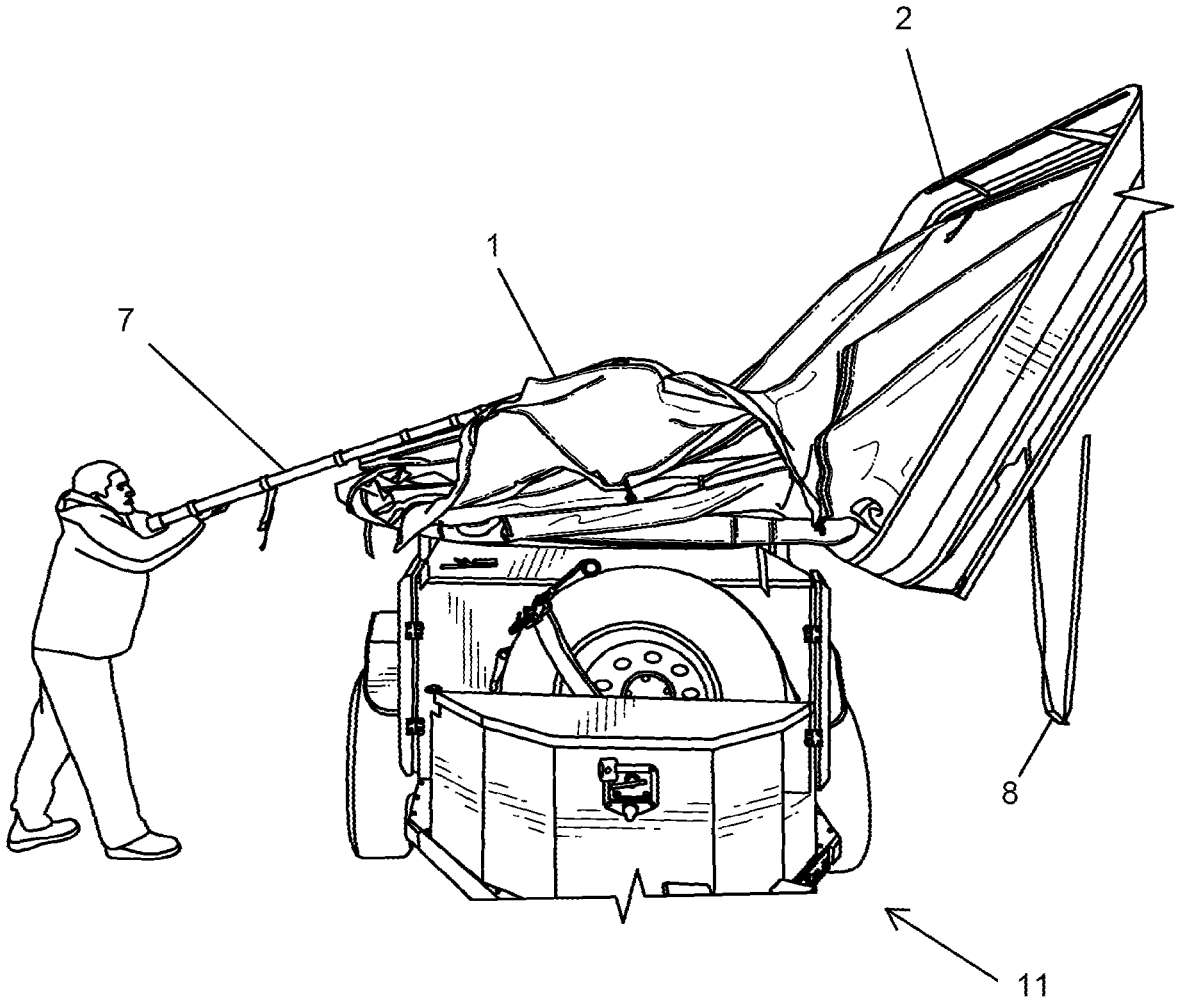
FIG. 22 is a perspective view of a user unfolding and assembling the tent from a trailer.

FIG. 22 is a perspective view of a user unfolding and assembling the tent from a trailer. The top 2 has rotated approximately 110 degrees out from the trailer, and the user grasps the ladder 7 to pull out and down on the inner fold-out section 9.

Figure 23:
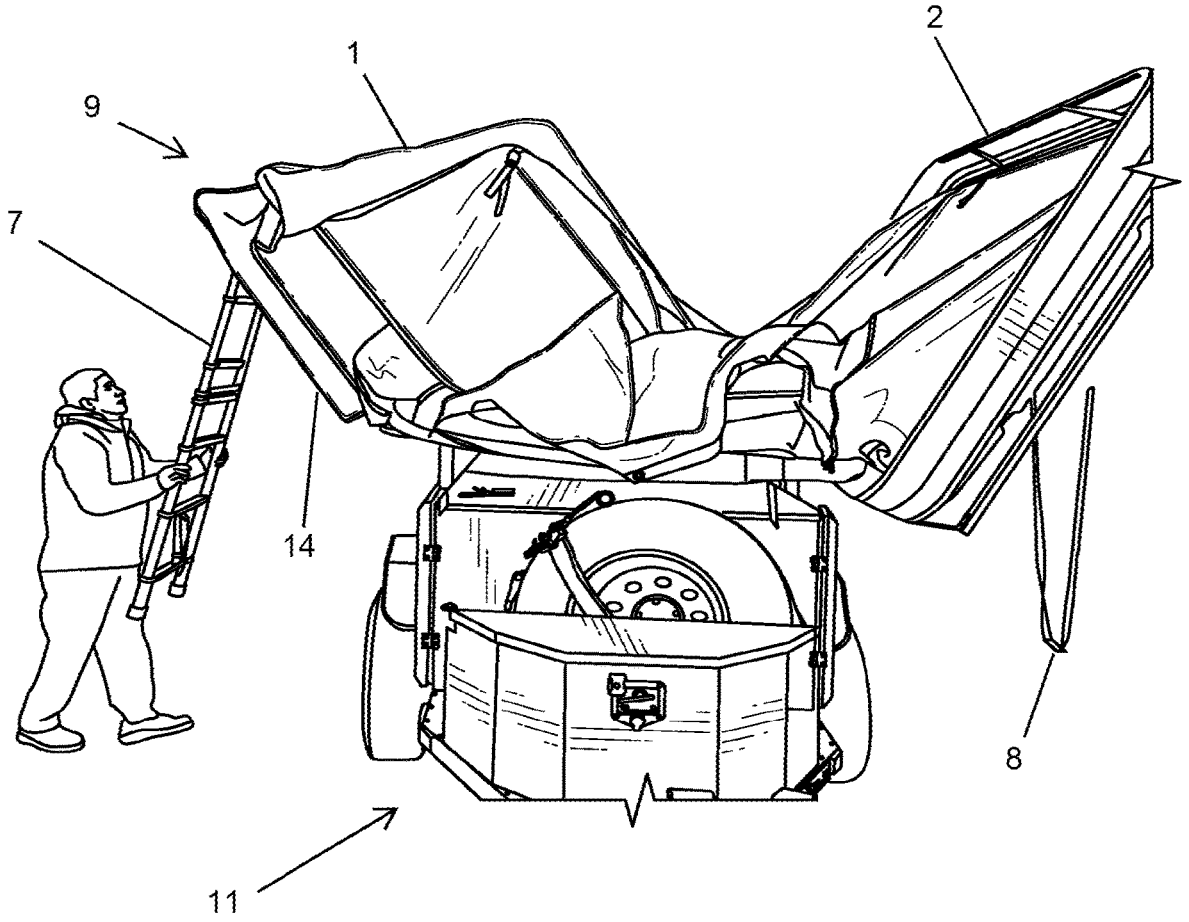
FIG. 23 is a perspective view of a user unfolding and assembling the tent from a trailer.

FIG. 23 is a perspective view of a user unfolding and assembling the tent from a trailer. As the user pulls down on the ladder 7, the internal frame of the tent pops up and give structure to the tent.

Figure 24:
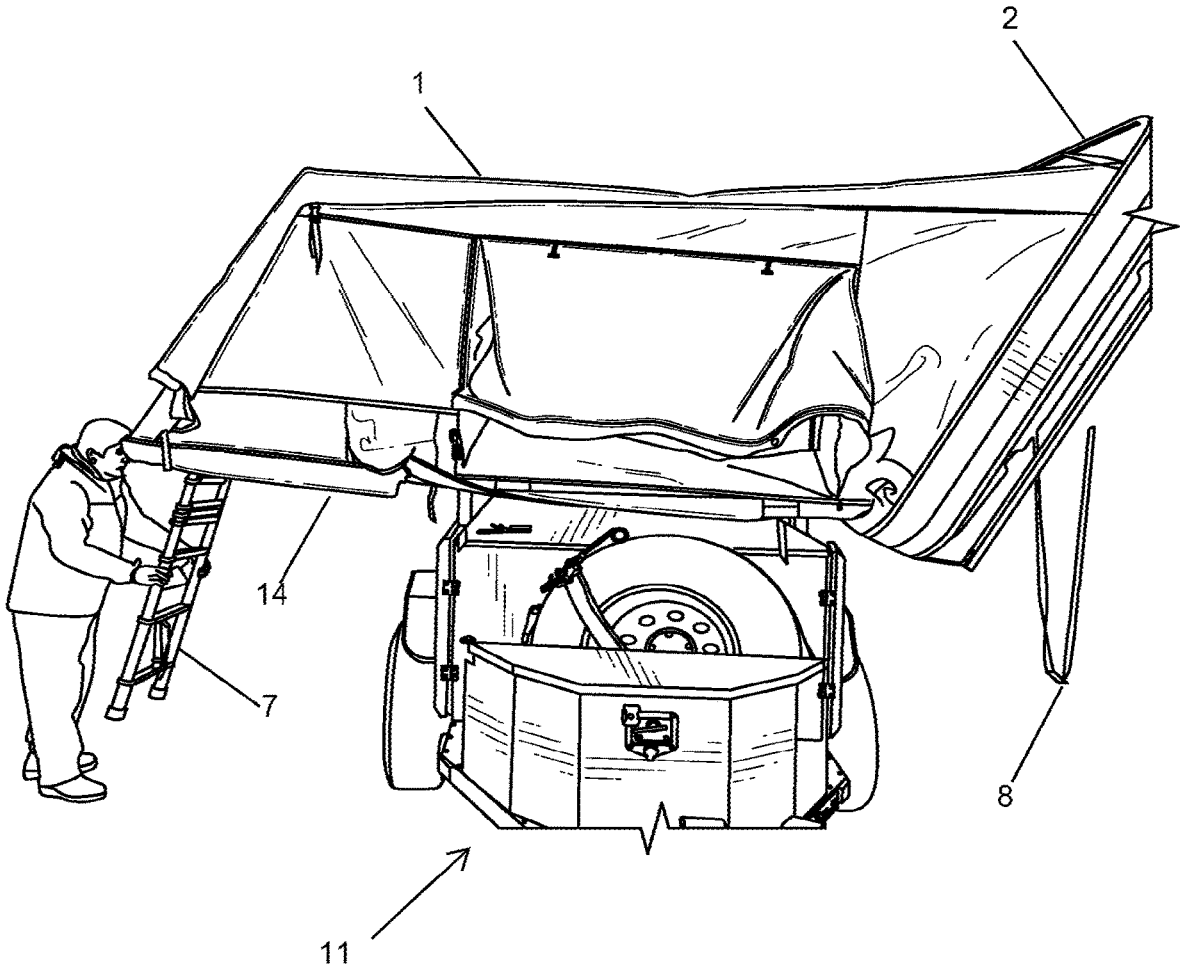
FIG. 24 is a perspective view of a user unfolding and assembling the tent from a trailer.

FIG. 24 is a perspective view of a user unfolding and assembling the tent from a trailer. The internal frame has popped up the inner fold-out section 9 and the tent has taken form. The user has opened the fold out base 14, which provides support to the inner fold-out section 9. The ladder 7 provides support to the outer edge of the fold out base 14.

Figure 25:
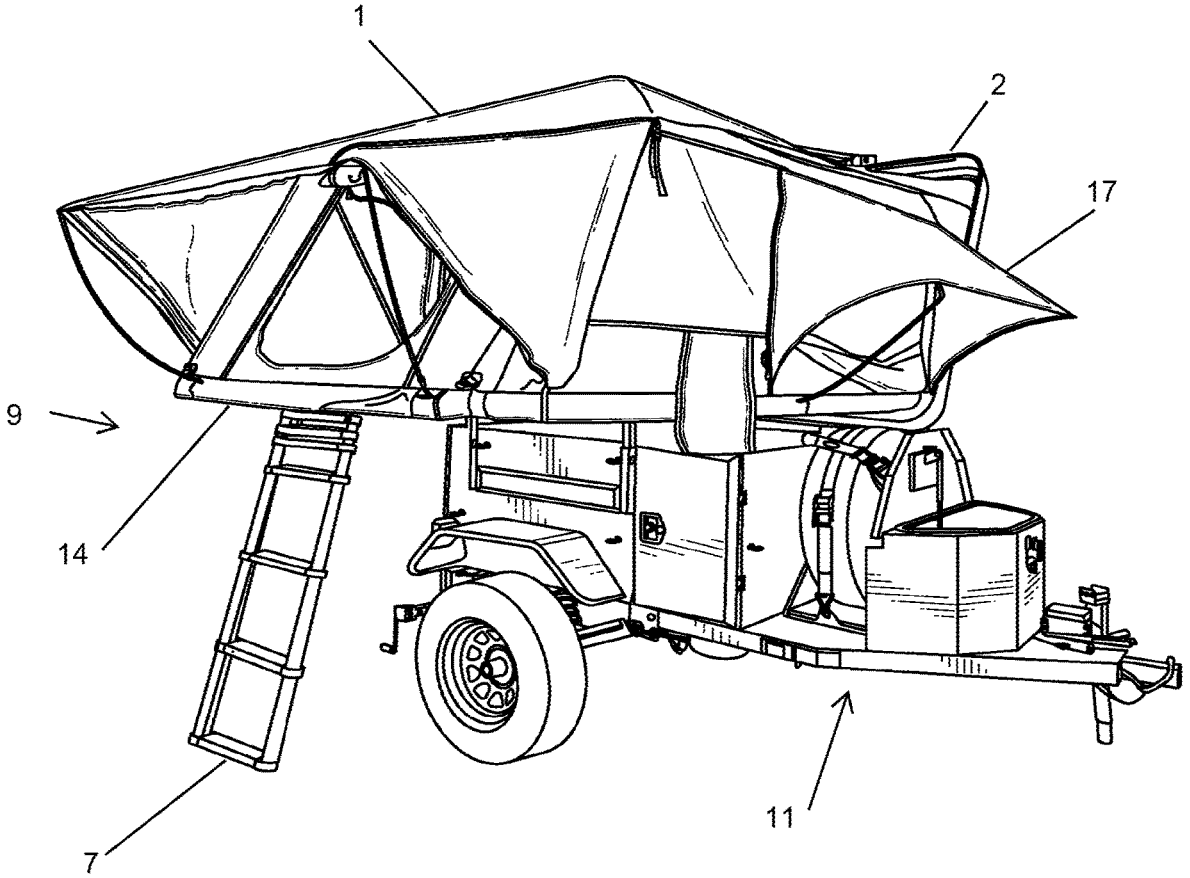
FIG. 25 is a perspective view of a user unfolding and assembling the tent from a trailer.

FIG. 25 is a perspective view of a user unfolding and assembling the tent from a trailer. The tent, generally 1, has been completely unfolded. The top 2 angles back at around 110 degrees, giving more internal room. The fold out base 14 is supported by the ladder 7.

Figure 26:
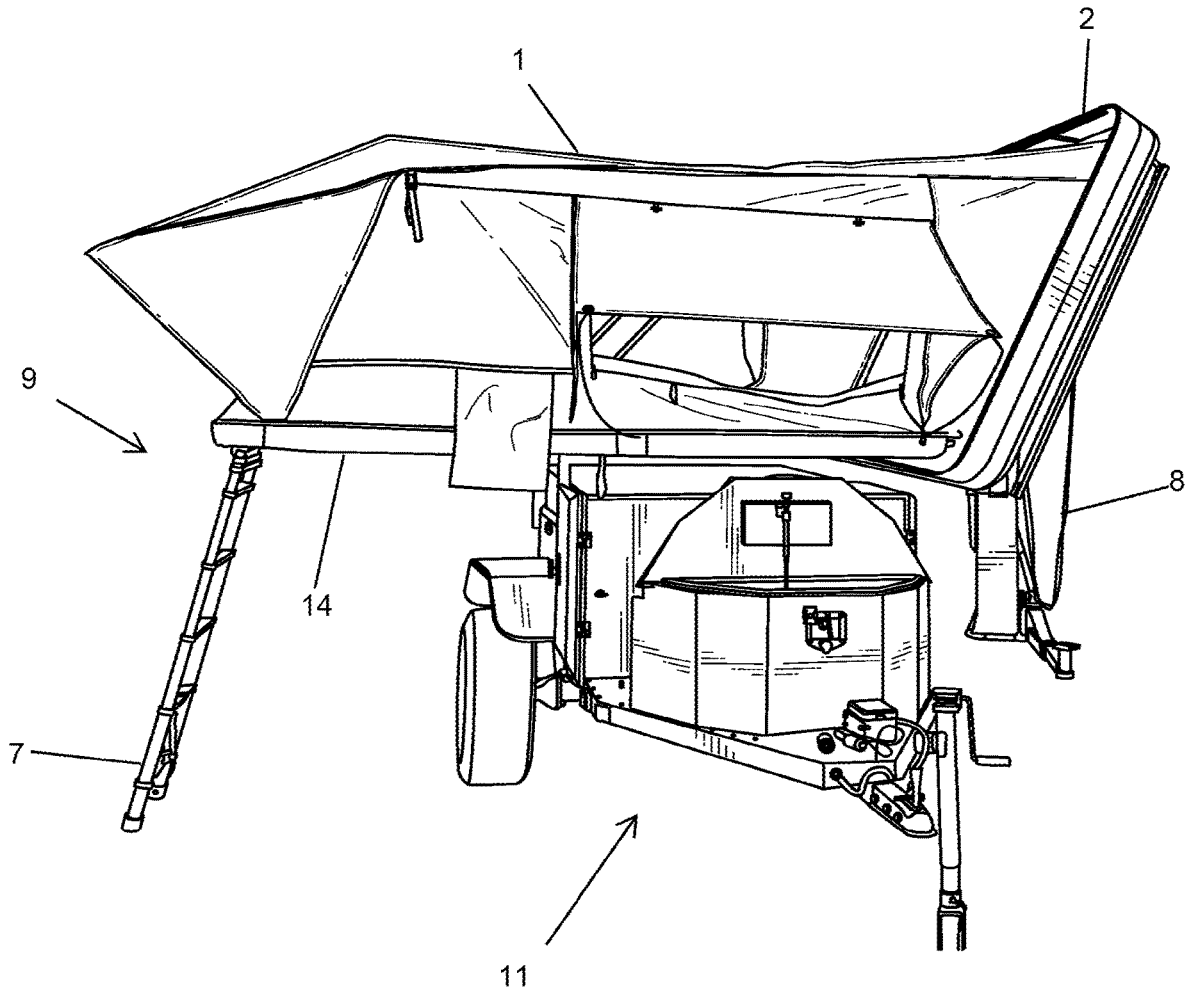
FIG. 26 is a perspective view of a user unfolding and assembling the tent from a trailer.

FIG. 26 is a perspective view of a user unfolding and assembling the tent from a trailer.

Figure 27:
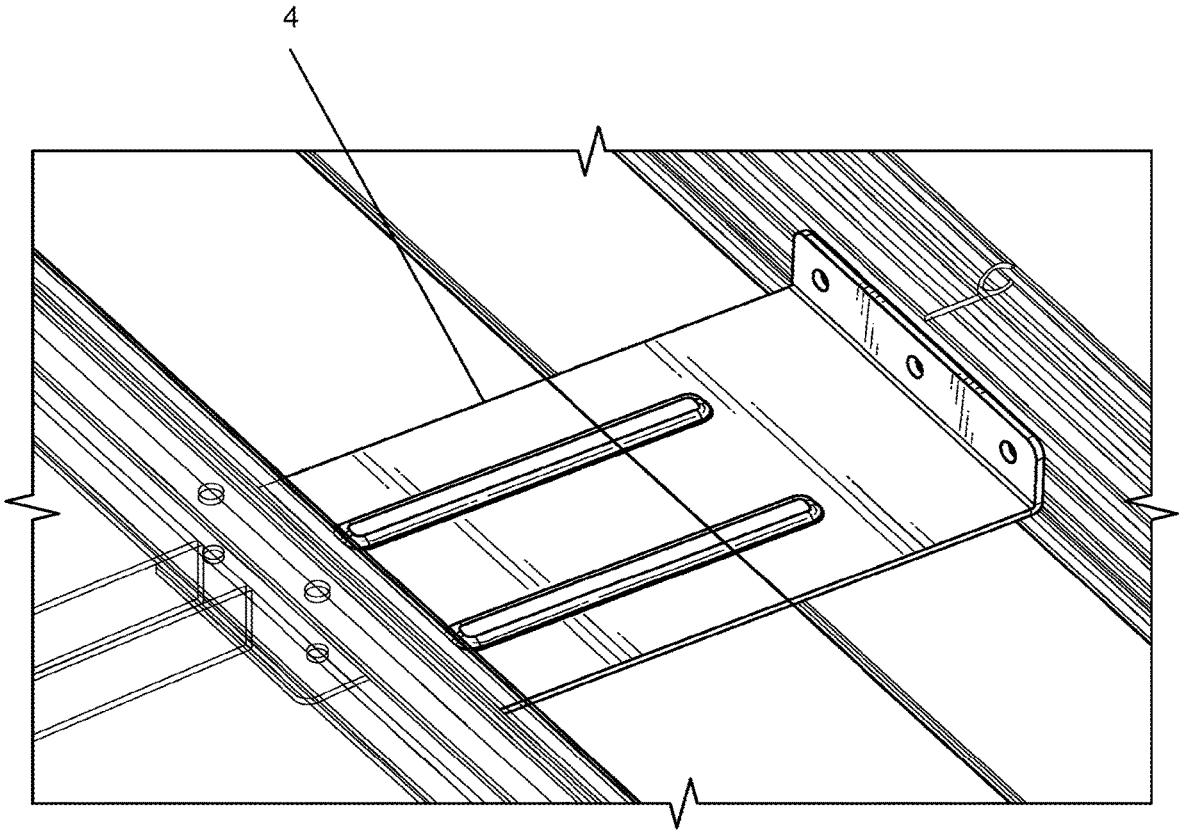
FIG. 27 is a perspective view of the hinge.

FIG. 27 is a perspective view of the hinge.

Figure 28:
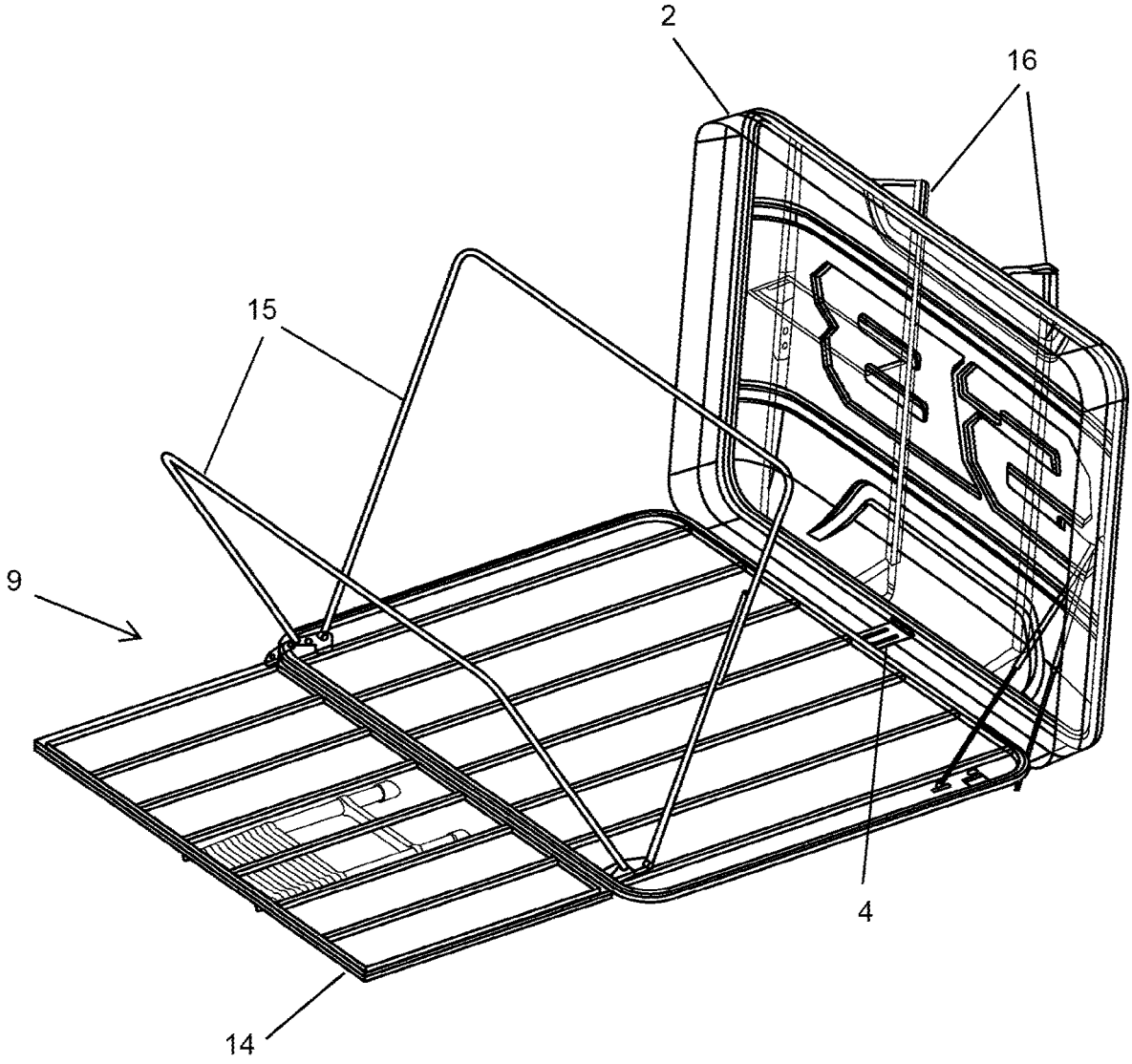
FIG. 28 is a perspective view of the internal frame components of the tent.

FIG. 28 is a perspective view of the internal frame 15 components of the tent.

Figure 29:
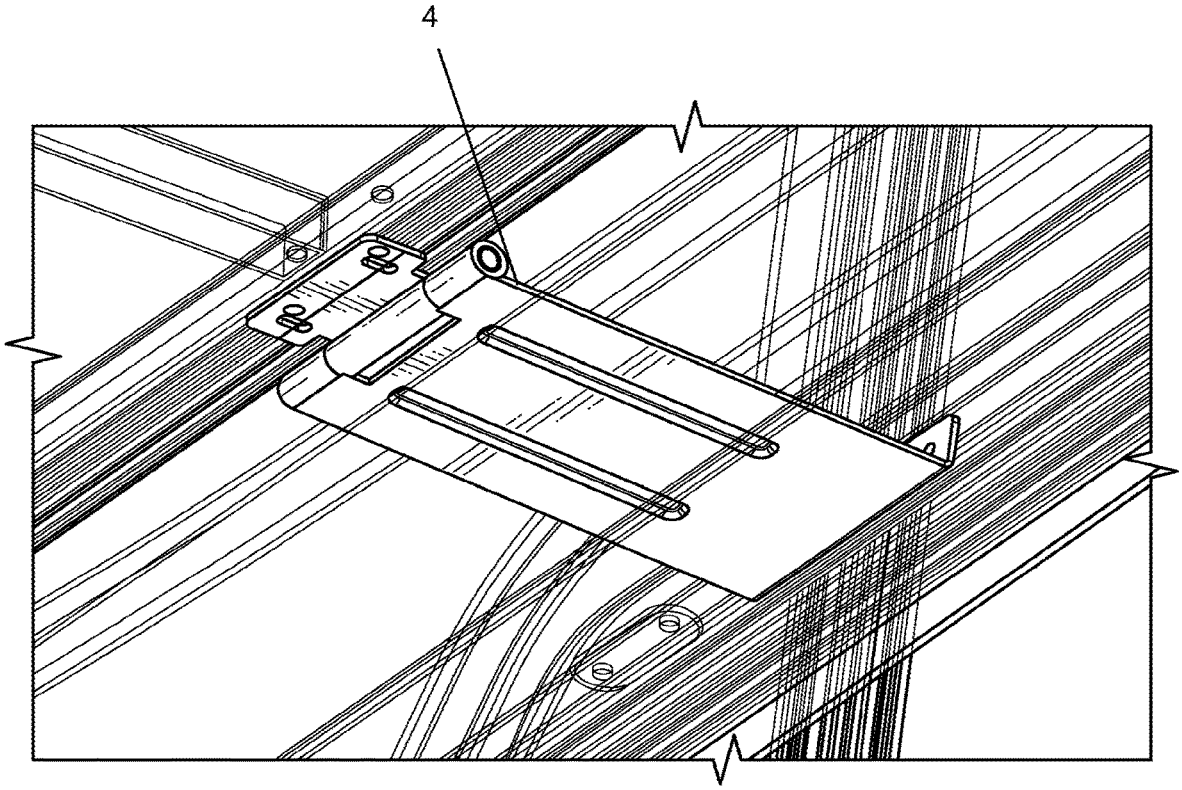
FIG. 29 is a perspective view of the hinge.

FIG. 29 is a perspective view of the hinge.

Figure 30:
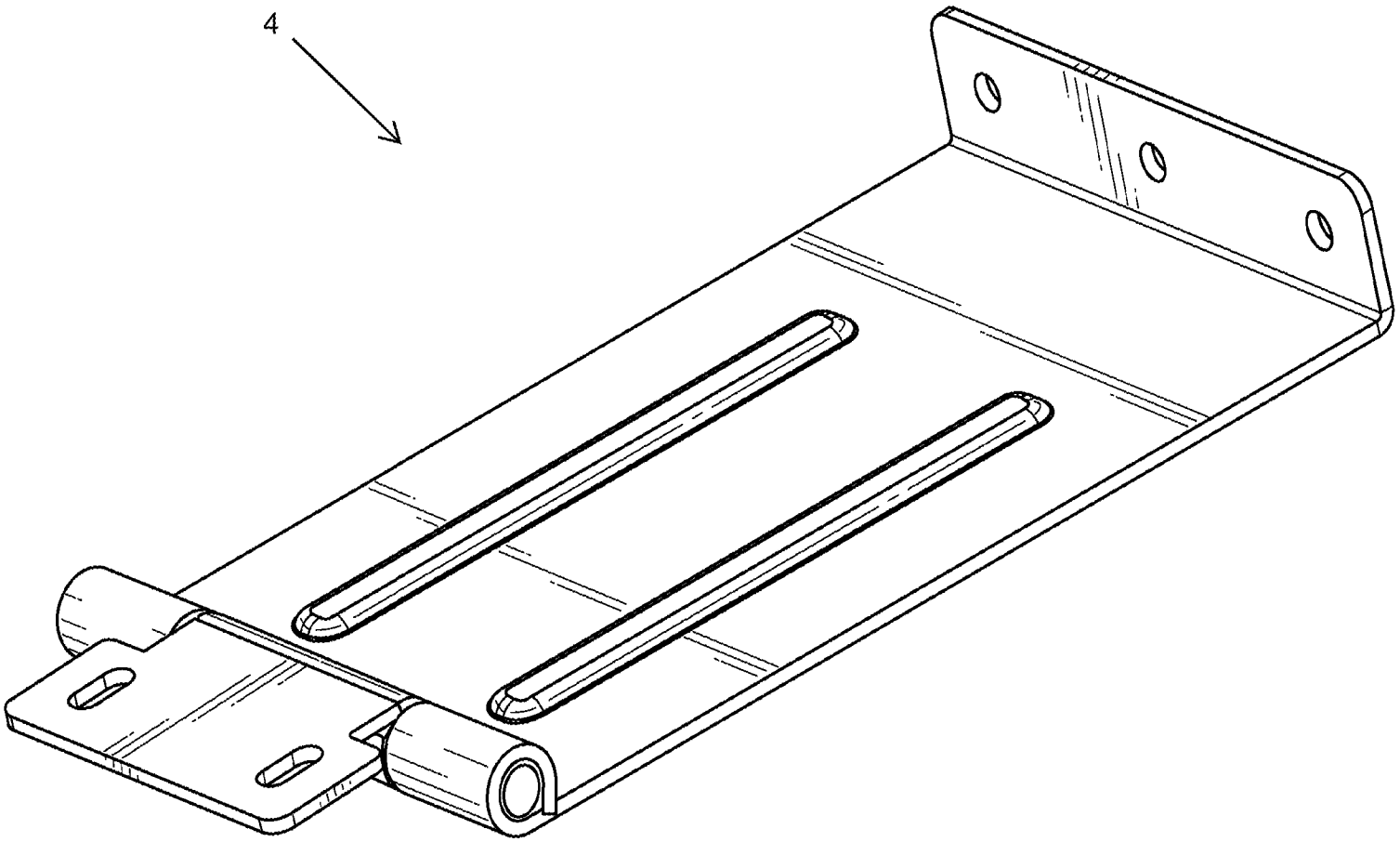
FIG. 30 is a perspective view of the hinge.

FIG. 30 is a perspective view of the hinge.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A vehicle tent, comprising:

a top portion including a pull rope;

an inner fold-out section, wherein the inner fold-out section has:

a fold-out base;

a ladder attached to the fold-out base;

a fixed base;

a tent body;

an internal frame;

one or more securing straps configured to attach the fixed base to a vehicle; and a hinge hingeably connecting the top portion to the fixed base, wherein pulling the pull rope rotates the top portion a first direction and the ladder is used to rotate the fold-out base a second direction, opposite the first direction, and supports an outer ridge of the fold-out base, and wherein rotating the top portion and the fold-out base causes the internal frame to move from a collapsed position to an extended position to support the tent body.

2. The vehicle tent of claim 1, wherein the fold-out base is attached to an underside of the fixed base.

3. The vehicle tent of claim 2, wherein rotation of the hinge 90 degrees creates a first interior volume of X cubic feet, rotation of the hinge more than 90 degrees and less than 110 degrees creates a second interior volume greater than X cubic feet, and rotation of the hinge at least 110 degrees creates a third volume greater than or equal to 1.2× cubic feet.

4. The vehicle tent of claim 1, wherein the vehicle tent has a fully-pitched configuration and a collapsed configuration, wherein in the collapsed configuration the top portion is removably attached to the fixed base such that the tent body is held below the top portion and above the fixed base, and wherein in the fully-pitched configuration the top portion serves as a front of the vehicle tent.

5. The vehicle tent of claim 4, wherein the vehicle tent additionally comprises at least one internal shelf, wherein the at least one internal shelf opens automatically as the vehicle tent is converted from the collapsed configuration to the fully-pitched configuration.

6. The vehicle tent of claim 5, wherein the vehicle is a truck and the vehicle tent attaches to a roof rack of the truck.

7. The vehicle tent of claim 5, wherein the vehicle is a trailer and the vehicle tent attaches to a trailer top of the trailer.

8. The vehicle tent of claim 5, wherein the ladder is a telescoping ladder.

9. A method of assembling a vehicle tent, comprising:

securing a vehicle tent to a vehicle, wherein the vehicle tent comprises a top portion, an inner fold-out section, wherein the inner fold-out section has a fold-out base, a fixed base, a tent body, an internal frame, one or more securing straps, and a hinge, wherein the top portion is hingeably connected to the fixed base, and the one or more securing straps attaching the fixed base to the vehicle, wherein the fold-out base is attached to an underside of the fixed base, wherein the hinge rotates more than 90 degrees, wherein the top portion comprises a pull rope, wherein a ladder is attached to the fold-out base, pulling the pull rope to rotate the top portion in an outward direction from the fixed base, and pulling the ladder to rotate the fold-out base in an opposition direction from the outward direction that the top portion is rotated, wherein the internal frame is rotated from a collapsed position to an extended position as the top portion and the fold-out base are rotated, wherein the ladder supports an outer ridge of the fold-out base, wherein the internal frame in the extended position supports the tent body.

10. The method of claim 9, wherein the vehicle tent has a fully-pitched configuration and a collapsed configuration, wherein in the collapsed configuration, the top portion is removably attached to the fixed base, such that the tent body is held below the top portion and above the fixed base, and wherein in the fully-pitched configuration the top portion is as a front of the vehicle tent.

11. The method of claim 10, wherein the vehicle tent additionally comprises at least one internal shelf, wherein the at least one internal shelf opens automatically as the vehicle tent is converted from the collapsed configuration to the fully-pitched configuration.

12. The method of claim 9, wherein the vehicle is a truck and the vehicle tent attaches to a roof rack of the truck.

13. The method of claim 9, wherein the vehicle is a trailer and the vehicle tent attaches to a trailer top of the trailer.

14. The method of claim 9, wherein the ladder is a telescoping ladder.

15. The method of claim 9, wherein rotating the hinge 90 degrees creates a first interior volume of X cubic feet, rotating of the hinge more than 90 degrees and less than 110 degrees creates a second interior volume greater than X cubic feet, and rotating the hinge at least 110 degrees creates a third interior volume greater than or equal to 1.2× cubic feet.

16. A tent comprising:

a fixed base having a top side and a bottom side opposite the top side, the bottom side configured for securing the tent to a vehicle;

a top portion having an outer side and inner side opposite the outer side;

a hinge hingeably connecting the top portion to the fixed base, the top portion movable between a closed position and an open position in which the top portion is rotated away from the fixed base such that an open angle defined between the top side of the fixed base and the inner side of the top portion is greater than 90 degrees;

an inner fold-out base hingeably connected to the fixed base opposite the top portion, the inner fold-out base moveable between a folded position and an unfolded position;

an internal frame pivotally attached to the top side of the fixed base, the internal frame having a down position and an extended position;

a pull rope attached to the top portion, the pull rope configured for a user to move the top portion from the closed position to the open position by pulling thereon;

a ladder attached to the inner fold-out base, the ladder configured for the user to move the inner fold-out base from the folded position to the unfolded position; and a tent body attached to the fixed base, the top portion, the inner fold-out base, and the internal frame, the tent body having a collapsed state and a pitched state in which the tent body defines an internal space;

wherein the tent has:

a collapsed configuration in which the top portion is in the closed position, the inner fold-out base is in the folded position, the internal frame is in the down position, and the tent body in the collapsed state, and a fully-pitched configuration in which the top portion is in the open position, the inner fold-out base is in the unfolded position, the internal frame is in the extended position, and the tent body is in the pitched state.

17. The tent according to claim 16, wherein the top portion is configured to support an occupant of the tent leaned thereagainst when the tent is in the fully-pitched configuration.

18. The tent according to claim 16, wherein the internal space defined by the tent body has a first volume before the top portion moves into the open position and the open angle is equal to 90 degrees and a second volume when the top portion is in the open position and the open angle is equal to 110 degrees, the second volume being twenty-percent larger than the first volume.

19. The tent according to claim 16, wherein the ladder supports an outer ridge of the inner fold-out base when the tent is in the fully-pitched configuration.

20. The tent according to claim 16, further comprising an internal shelf within the tent body, the internal shelf having a deployed position and an undeployed position, the internal shelf transitioning from the undeployed position automatically as the tent is moved to the fully-pitched configuration.

* * * * *